US007153058B2

(12) United States Patent
Lindley

(10) Patent No.: US 7,153,058 B2
(45) Date of Patent: Dec. 26, 2006

(54) APPARATUS FOR FINISHING CONCRETE

(76) Inventor: Joe Lindley, 201 Matthew Dr., Paducah, KY (US) 42001

( * ) Notice: Subject to any disclaimer, the term of this patent is extended or adjusted under 35 U.S.C. 154(b) by 0 days.

(21) Appl. No.: 11/045,421

(22) Filed: Jan. 28, 2005

(65) Prior Publication Data

US 2005/0158121 A1 Jul. 21, 2005

Related U.S. Application Data

(63) Continuation-in-part of application No. 10/513,920, filed as application No. PCT/US03/15139 on May 14, 2003, now Pat. No. 7,097,384.

(60) Provisional application No. 60/545,322, filed on Feb. 17, 2004, provisional application No. 60/540,125, filed on Jan. 29, 2004, provisional application No. 60/412,996, filed on Sep. 23, 2002, provisional application No. 60/385,732, filed on Jun. 4, 2002, provisional application No. 60/383,512, filed on May 28, 2002, provisional application No. 60/380,536, filed on May 14, 2002.

(51) Int. Cl.
*E01C 19/30* (2006.01)
*E01C 19/22* (2006.01)
*E01C 19/35* (2006.01)

(52) U.S. Cl. ..... 404/118; 404/112; 404/115; 404/116

(58) Field of Classification Search ..... 404/85, 404/114, 118, 116, 112, 115
See application file for complete search history.

(56) References Cited

U.S. PATENT DOCUMENTS 1,955,101 A 4/1934 Sloan
2,167,987 A * 8/1939 Mall ..... 366/122
2,180,198 A 11/1939 Day
2,255,343 A 9/1941 Baily
2,303,335 A 12/1942 Day
2,314,985 A * 3/1943 Jackson ..... 404/114
2,386,662 A 10/1945 Crock
2,400,321 A 5/1946 Troxell
2,430,817 A * 11/1947 Jackson ..... 173/170
2,651,980 A 9/1953 Wells et al.
2,746,367 A 5/1956 Ferguson
3,427,939 A 2/1969 Braff et al.
3,782,693 A * 1/1974 Strohbeck ..... 366/122
3,883,259 A 5/1975 Berg et al.
4,043,694 A 8/1977 Mullen
4,073,593 A * 2/1978 Storm ..... 404/114
4,349,295 A 9/1982 Morrison
4,359,296 A 11/1982 Cronkhite
4,375,351 A 3/1983 Allen
4,386,901 A 6/1983 Morrison
4,388,018 A 6/1983 Boschung
4,408,978 A 10/1983 Owens
4,591,291 A * 5/1986 Owens ..... 404/118
4,641,995 A 2/1987 Owens
4,798,494 A 1/1989 Allen
4,838,730 A 6/1989 Owens
4,848,961 A 7/1989 Rouillard
4,861,188 A 8/1989 Rouillard
4,911,575 A 3/1990 Tidwell
5,096,330 A 3/1992 Artzberger
5,244,305 A * 9/1993 Lindley ..... 404/97

(Continued)

*Primary Examiner*—Raymond Addie
(74) *Attorney, Agent, or Firm*—Barnes & Thornburg LLP

(57) ABSTRACT

A vibratory screed apparatus includes a vibrator, a screed, and a coupler for coupling the vibrator to the screed. The vibratory screed apparatus may be provided as a concrete-finishing kit which is capable of being assembled and disassembled in the field. A number of other concrete-finishing kits are also disclosed.

20 Claims, 17 Drawing Sheets

U.S. PATENT DOCUMENTS

| | | | | | |
|---|---|---|---|---|---|
| D343,998 | S | | 2/1994 | Griggs | |
| 5,375,942 | A | * | 12/1994 | Lindley et al. | 404/97 |
| 5,829,874 | A | * | 11/1998 | Breeding | 366/120 |
| 5,857,803 | A | | 1/1999 | Davis et al. | |
| 5,984,571 | A | | 11/1999 | Owens | |
| 6,065,859 | A | * | 5/2000 | Breeding | 366/121 |
| 6,132,134 | A | | 10/2000 | Hodgson | |
| 6,139,217 | A | | 10/2000 | Reuter | |
| 6,200,065 | B1 | * | 3/2001 | Eitzen | 404/114 |
| 6,231,331 | B1 | * | 5/2001 | Lievers | 425/183 |
| 6,296,467 | B1 | * | 10/2001 | Rouillard | 425/182 |
| 6,374,569 | B1 | | 4/2002 | Suckow | |
| 6,705,799 | B1 | | 3/2004 | Piccoli | |
| 2002/0102134 | A1 | | 8/2002 | Piccoli | |

* cited by examiner

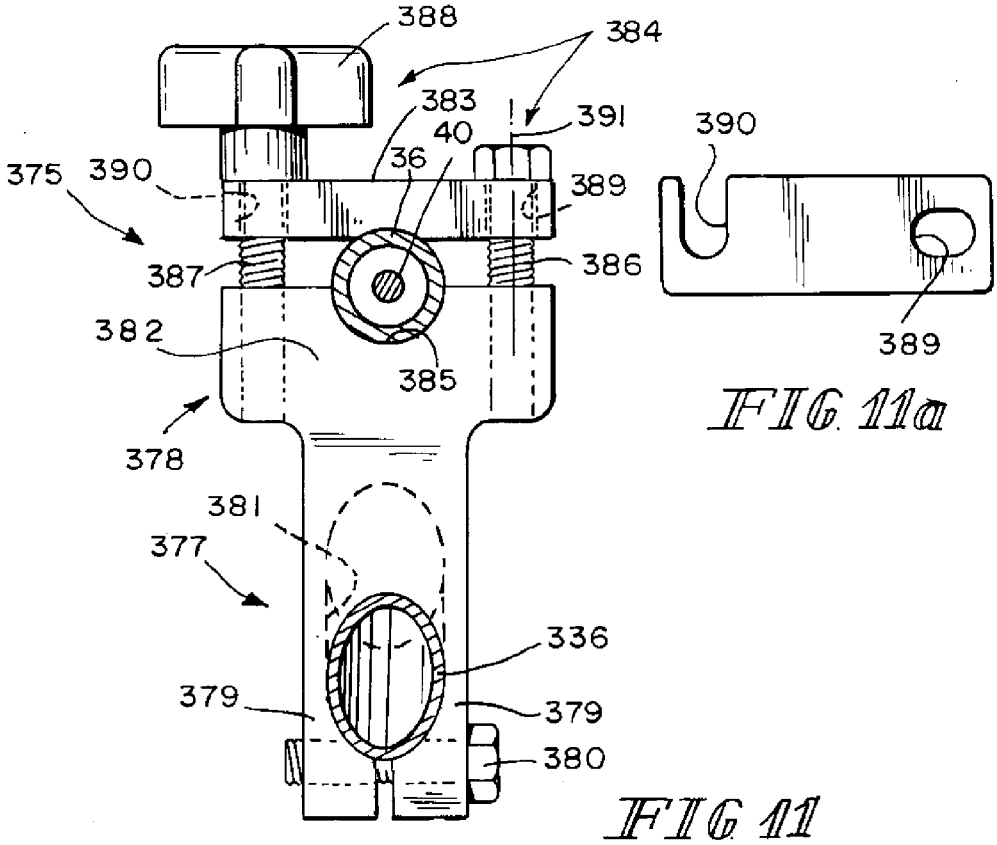
FIG 11a
FIG 11
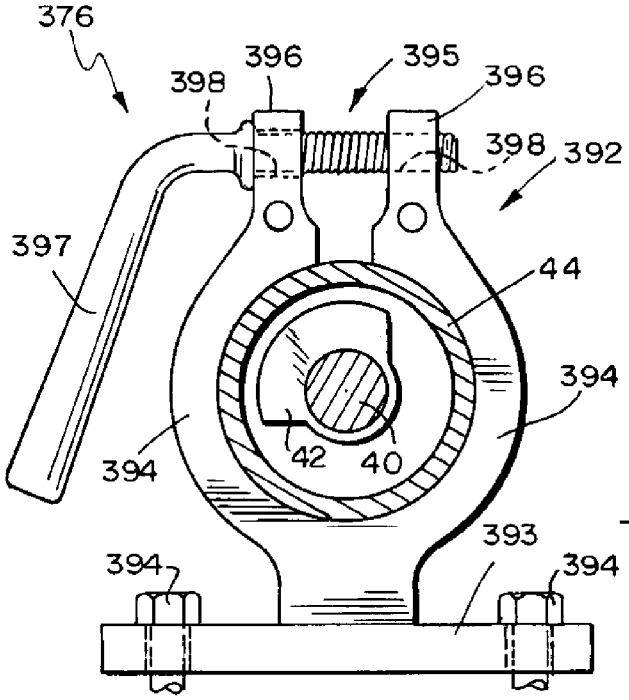
FIG 12

APPARATUS FOR FINISHING CONCRETE

This application claims the benefit under 35 U.S.C. § 119(e) of U.S. Provisional Application No. 60/540,125 filed Jan. 29, 2004 and U.S. Provisional Application No. 60/545,322 filed Feb. 17, 2004. This application is a continuation-in-part of U.S. application Ser. No. 10/513,920 now U.S. Pat. No. 7,097,384, which is the National Stage of International Application No. PCT/US2003/015139, filed May 14, 2003, which claims the benefit under 35 U.S.C. § 119(e) of U.S. Provisional Application No. 60/380,536 filed May 14, 2002, U.S. Provisional Application No. 60/383,512 filed May 28, 2002, U.S. Provisional Application No. 60/385,732 filed Jun. 4, 2002, and U.S. Provisional Application No. 60/412,996 filed Sep. 23, 2002. The following are thus hereby incorporated by reference herein: U.S. patent application Ser. No. 10/513,920, PCT International Application No. PCT/US2003/015139, and U.S. Provisional Application Nos. 60/540,125; 60/545,322; 60/380,536; 60/383,512; 60/385,732; and 60/412,996.

BACKGROUND

The present disclosure relates to apparatus for finishing freshly placed concrete.

A variety of tools are used to finish freshly placed concrete. Such tools may be used to vibrate and consolidate the concrete, to screed or otherwise level the concrete, to form an edge along the side of the concrete, to smooth a surface of the concrete, to form a groove in a surface of the concrete, or otherwise treat the concrete before it completely hardens.

SUMMARY

According to the present disclosure, a vibratory screed apparatus includes a flexible-hose vibrator, a screed bar, and an attachment device coupling the flexible-hose vibrator to the screed bar to allow the flexible-hose vibrator to vibrate the screed bar to facilitate screeding of freshly placed concrete. The vibratory screed apparatus may be provided as a concrete-finishing kit in which components of the apparatus are capable of being assembled and disassembled in the field. In such a case, the vibrator may be used as a stand-alone device to vibrate concrete or may be mounted to vibrate the screed bar.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which:

FIG. 11 is a sectional view taken along lines 11—11 of FIG. 8 showing a releasable upper tube clamp of the first coupler clamped to an tube of the first vibrator and a releasable lower frame clamp of the first coupler clamped to the frame of the first screed;

FIG. 11*a* is top plan view of a movable jaw included in the tube clamp;

FIG. 12 is a sectional view taken along lines 12—12 of FIG. 8 showing the releasable head clamp of the first coupler clamped to the vibration head of the first vibrator;

DETAILED DESCRIPTION

Figure 1:
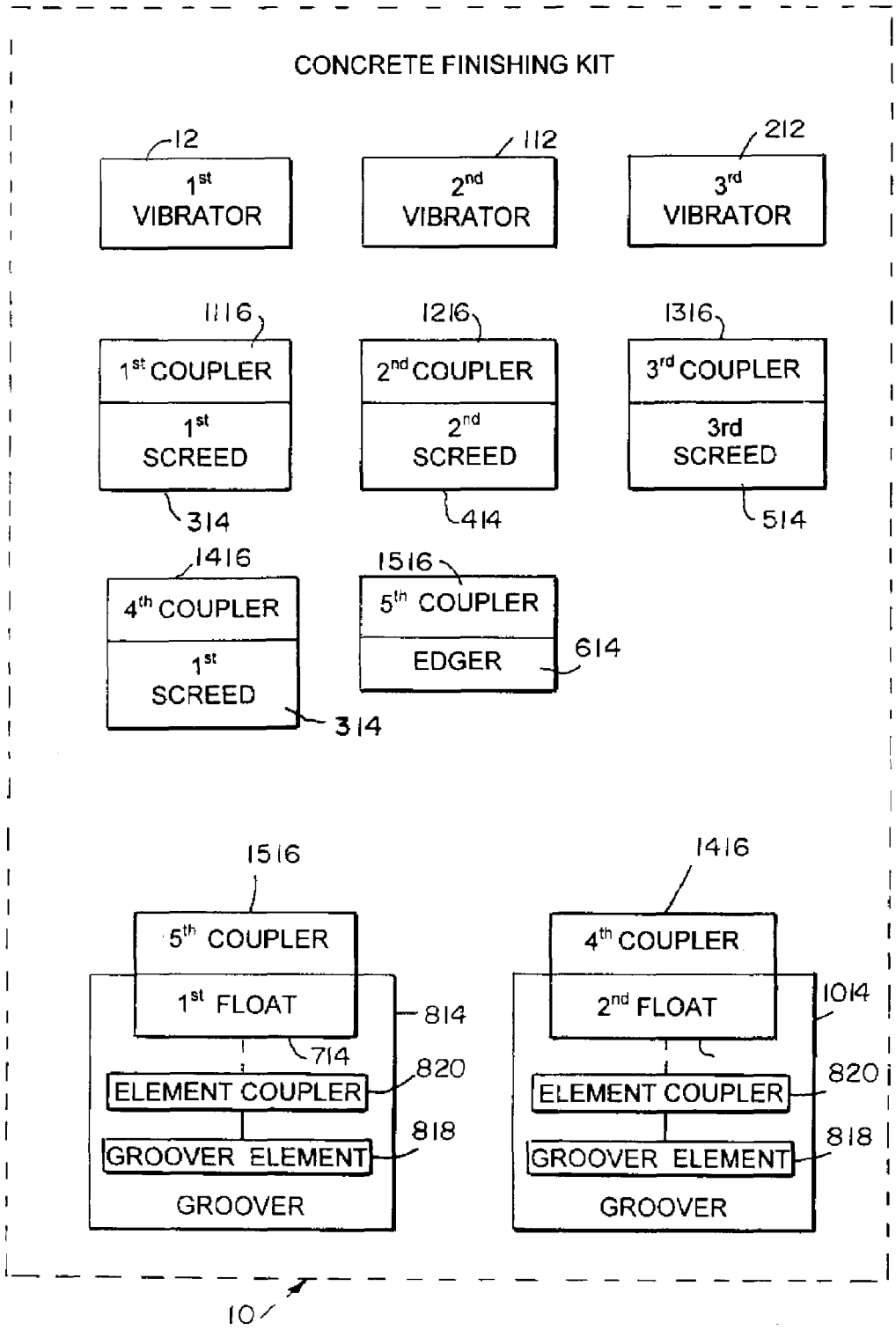
FIG. 1 is a diagrammatic view showing a concrete-finishing kit including concrete vibrators, concrete-finishing tools, and couplers, each coupler being adapted to couple a vibrator to a concrete-finishing tool to allow the vibrator to vibrate the tool during use of the tool to finish concrete and being adapted to uncouple the vibrator from the tool to allow use of the vibrator as a stand-alone device apart from the tool to vibrate concrete.

A concrete-finishing kit 10 includes concrete vibrators 12, 112, 212, concrete-finishing tools 314, 414, 514, 614, 714, 814, 914, 1014, and couplers 1116, 1216, 1316, 1416, 1516, as shown diagrammatically, for example, in FIG. 1. Each vibrator 12, 112, 212 is adapted to be operated as a stand-alone device to vibrate and thereby consolidate freshly placed concrete. Each coupler 1116, 1216, 1316, 1416, 1516, is adapted to couple a vibrator 12, 112, 212 to a tool 314, 414, 514, 614, 714, 814, 914, 1014 to allow vibrator 12, 112, 212 to vibrate tool 314, 414, 514, 614, 714, 814, 914, 1014 during use thereof to finish concrete. Kit 10 thus includes components capable of being assembled and disassembled in the field.

Figure 2:
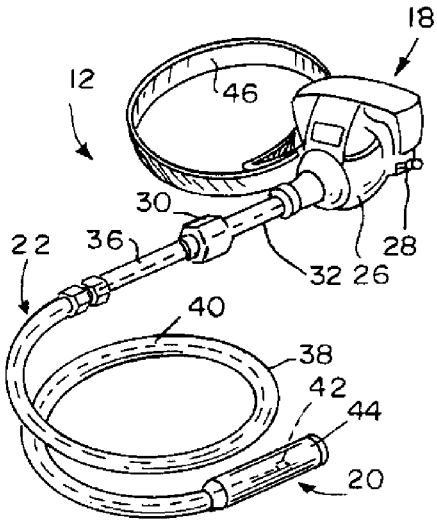
FIGS. 2 and 3 are perspective views showing a first "flexible-hose" vibrator adapted to vibrate and thereby consolidate concrete.
Figure 3:
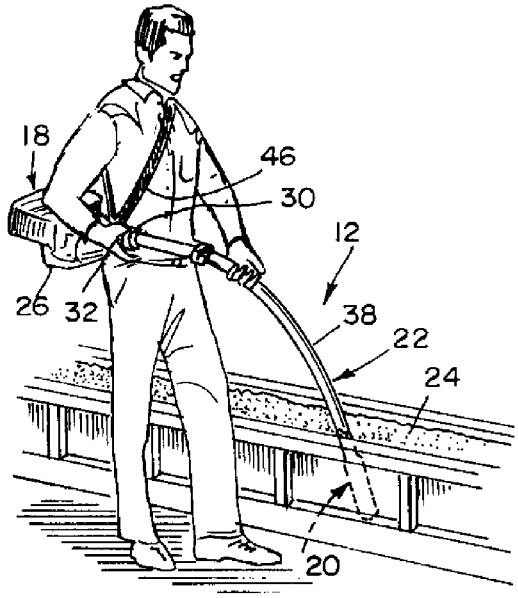

Flexible-hose vibrator 12 is adapted to vibrate and thereby consolidate concrete 24 when vibrator 12 is used as a stand-alone device, as shown, for example, in FIGS. 2 and 3. Vibrator 12 includes a power unit 18, a vibration head 20, and a connector 22 connecting power unit 18 and vibration head 20. Power unit 18 operates through connector 22 to vibrate vibration head 20. Vibration head 20 is configured to be inserted into freshly placed concrete 24 to vibrate concrete 24 to remove pockets of air and other voids from concrete 24 to consolidate concrete 24 when vibrator 12 is used as a stand-alone device.

Power unit 18 includes a motor 26 and a fuel tank 28. Motor 26 is configured to combust fuel stored in a fuel tank 28 coupled to motor 26 to provide a power output (e.g., 1.5 horsepower). A throttle 30 is configured to control the speed of motor 26. It is within the scope of this disclosure for motor 26 to be an electric motor. In such a case, fuel tank 28 could be eliminated from power unit 18.

Connector 22 includes a handle 32 adapted to be gripped by a person 34, a generally inflexible tube 36 extending from handle 32, a flexible hose 38 extending from tube 36 to vibration head 20, and a flexible drive shaft 40 (e.g., flexible cable) rotated by motor 26 and extending through handle 32, tube 36, and hose 38 to vibration head 20 to rotate an eccentric 42 of vibration head 20 mounted for rotation in an eccentric housing 44 of vibration head 20. A shoulder strap 46 is coupled to handle 32 to facilitate carrying vibrator 12 by person 34.

Figure 4:
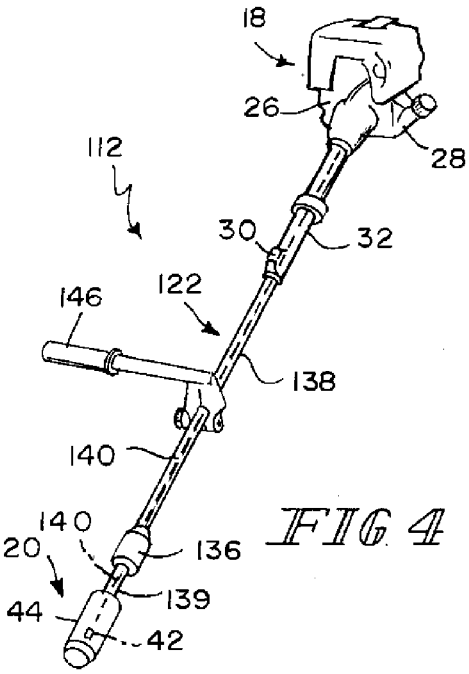
FIGS. 4 and 5 are perspective views showing a second "inflexible" vibrator adapted to vibrate and thereby consolidate concrete.
Figure 5:
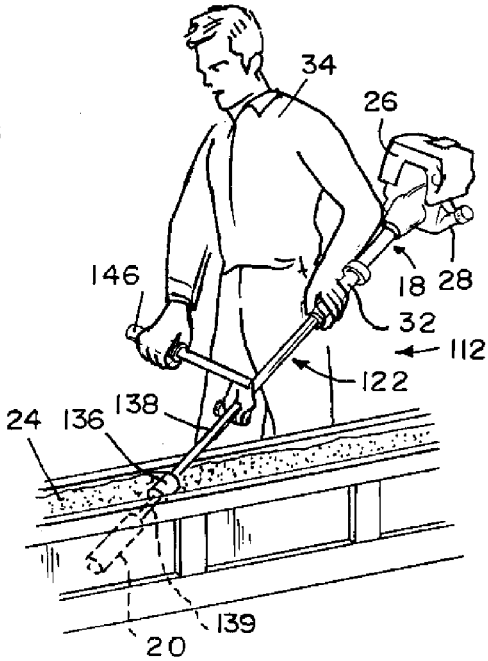

Vibrator 112 is adapted to vibrate and thereby consolidate concrete 24 when vibrator 112 is used as a stand-alone device, as shown, for example, in FIGS. 4 and 5. Vibrator 112 includes power unit 18, vibration head 20, and a connector 122 connecting power unit 18 and vibration head 20. Power unit 18 operates through connector 122 to vibrate vibration head 20. Vibration head 20 is configured to be inserted into freshly placed concrete 24 to vibrate concrete 24 to remove pockets of air and other voids from concrete 24 to consolidate concrete 24 when vibrator 112 is used as a stand-alone device.

Connector 122 includes handle 32, a vibration isolator 136, a generally inflexible first tube 138 extending between handle 32 and isolator 136, a generally inflexible second tube 139 extending between isolator 136 and vibration head 20, and a drive shaft 140 (e.g., flexible cable) rotated by motor 26 and extending through tubes 138, 139 and isolator 136 to vibration head 20 to rotate eccentric 42. Isolator 136 is arranged to isolate vibration of vibration head 20 from power unit 18. A handle 146 is coupled to first tube 138 and is adapted to be gripped by person 34 to facilitate carrying vibrator 112.

Figure 6:
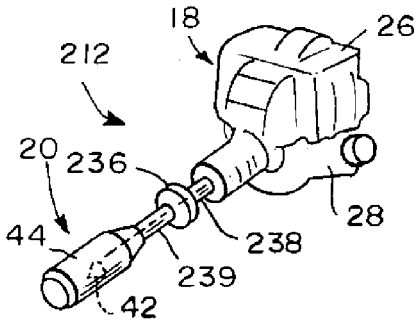
FIGS. 6 and 7 are perspective views showing a third vibrator that is smaller than the first and second vibrators and adapted to vibrate and thereby consolidate concrete.
Figure 7:
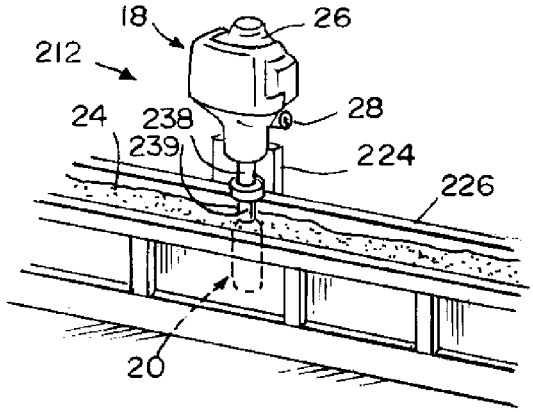

Vibrator 212 is adapted to vibrate and thereby consolidate concrete 24 when vibrator 212 is used as a stand-alone device, as shown, for example, in FIGS. 6 and 7. Vibrator 212 includes power unit 18, vibration head 20, and a connector 222 connecting power unit 18 and vibration head 20. Power unit 18 is coupled to a mount 224 extending between power unit 18 and a form 226. Power unit 18 operates through connector 222 to vibrate vibration head 20. Vibration head 20 is configured to be inserted into freshly placed concrete 24 to vibrate concrete 24 to remove pockets of air and other voids from concrete 24 to consolidate concrete 24 when vibrator 212 is used as a stand-alone device.

Connector 222 includes a vibration isolator 236, a generally inflexible first tube 138 extending between power unit and isolator 236, a generally inflexible second tube 239 extending between isolator 236 and vibration head 20, and a drive shaft 240 (e.g., flexible cable) rotated by motor 26 and extending through tubes 238, 239 and isolator 236 to vibration head 20 to rotate eccentric 42. Isolator 236 is arranged to isolate vibration of vibration head 20 from power unit 18.

Figure 8:
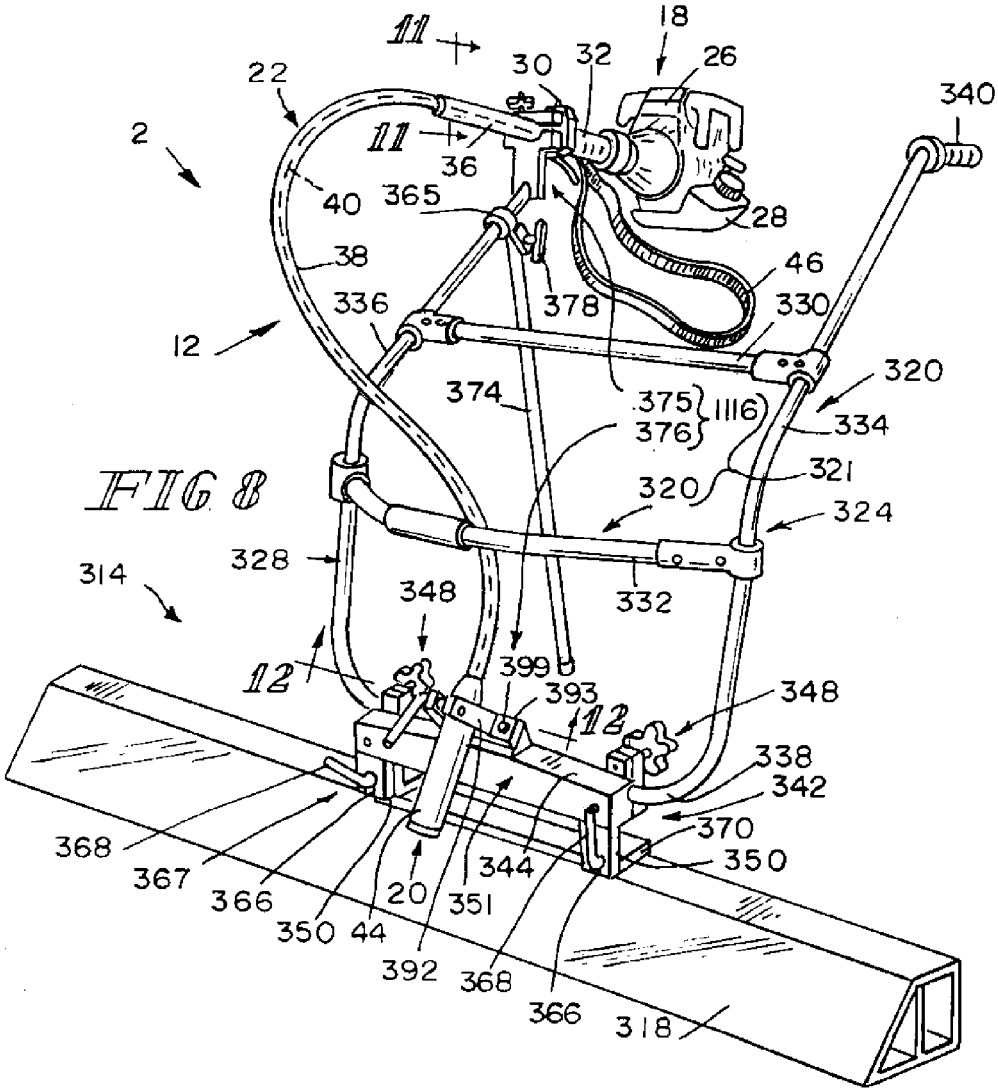
FIGS. 8 and 9 are perspective views showing use of a first coupler to couple the first vibrator to a first screed adapted to level concrete.
Figure 9:
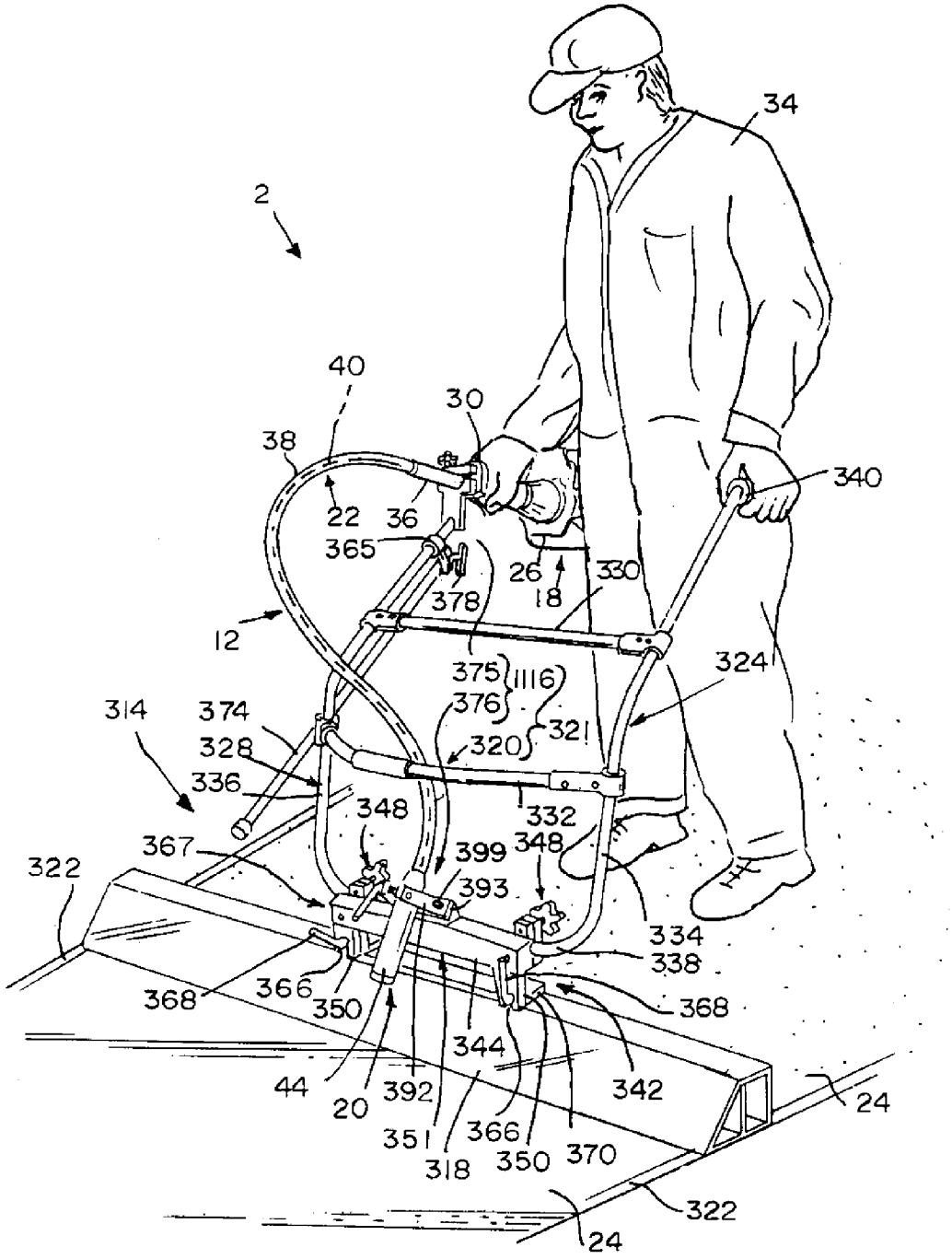

A first vibratory screed apparatus 2 includes first vibrator 12, a first screed 314 adapted to level concrete 24, and a first coupler 1116, as shown, for example, in FIGS. 8 and 9. First coupler 1116 is adapted to couple vibrator 12 to screed 314 to allow vibrator 12 to vibrate screed 314 during use of screed 314 to level concrete 24 and is adapted to uncouple vibrator 12 from screed 314 to allow use of vibrator 12 as a stand-alone device apart from screed 314 to vibrate concrete 24. First coupler 1116 thus provides means for coupling vibrator 12 to screed 314 to allow vibrator 12 to vibrate screed 314 during use of screed 314 to finish concrete 24 and for uncoupling vibrator 12 from screed 314 to allow use of vibrator 12 as a stand-alone device apart from screed 314 to vibrate concrete 24.

Screed 314 includes a screed bar 318 and a frame 320 to which screed bar 318 and first coupler 1116 are coupled, as shown, for example, in FIGS. 8 and 9. Screed bar 318 is adapted to engage and move along concrete 24 to level concrete 24. Forms 322 may be used to guide movement of screed bar 318 thereon. Coupler 1116 provides means for coupling power unit 18 and vibration head 20 to frame 320 to allow vibration head 20 to vibrate screed bar 318 in response to transmission of power from power unit 18 to vibration head 20 by use of drive shaft 40 extending through flexible hose 38. Frame 320 and first coupler 1116 thus provide an attachment device 321 coupling vibrator 12 to screed bar 318 to allow vibration head 20 to vibrate screed bar 318 in response to transmission of power from power unit 18 to vibration head 20 by use of drive shaft 40 extending through handle 32, inflexible tube 36, and flexible hose 38.

Frame 320 includes a support 324, as shown, for example, in FIGS. 8 and 9. Support 324 includes a generally U-shaped main member 328, an upper transverse member 330, and a lower transverse member 332. Upper and lower transverse members 330, 332 are coupled to parallel first and second side portions 334, 336 that are included in main member 328 and are connected by a transversely extending bottom portion 338 also included in main member 328. A first side handle 340 adapted to be gripped by person 34 to control apparatus 2 is coupled to first side portion 334. Handle 32 of vibrator 12 provides a second side handle adapted to be gripped by person 34 to control apparatus 2.

Figure 10:
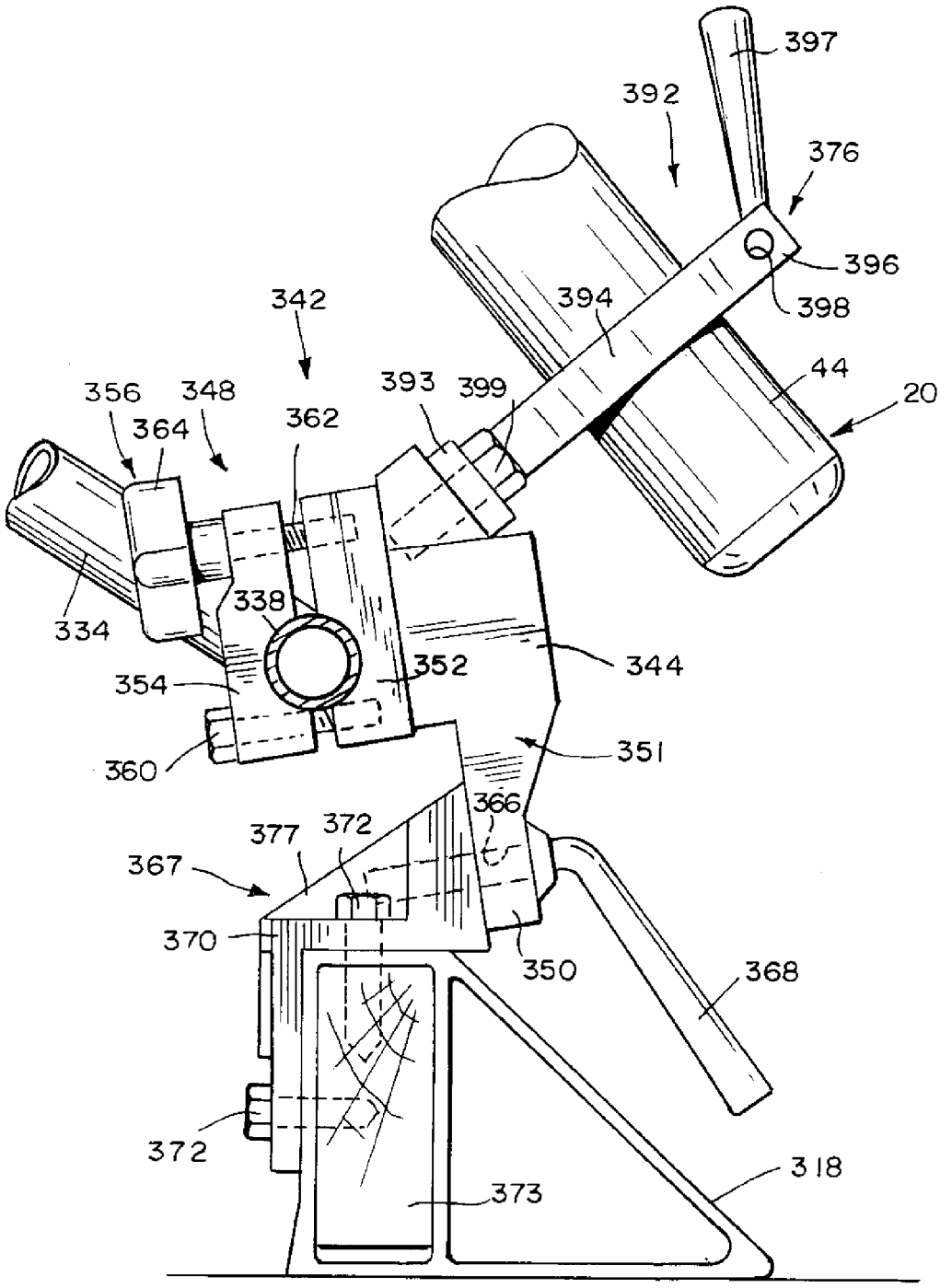
FIG. 10 is a side elevation view, with portions broken away, showing use of a releasable head clamp of the first coupler to couple a vibration head of the first vibrator to a frame of the first screed and showing a screed bar of the first screed coupled to the frame.

Frame 320 includes a mount 342 to which screed bar 318 and support 324 are coupled, as shown, for example, in FIGS. 8–10. Mount 342 includes a strut 344, a pair of support clamps 348 coupled to strut 344 and clamped to bottom portion 338, and a pair of feet 350 depending from strut 344 and to which screed bar 318 is coupled. Strut 344 and feet 350 cooperate to provide a yoke 351.

Each clamp 348 includes a fixed jaw 352, a movable jaw 354, and a jaw mover 356, as shown, for example, in FIG. 10. Fixed jaw 352 is coupled to strut 344 against movement relative thereto. Such coupling may occur by use of one or more fasteners or by forming fixed jaw 352 and strut 344 as a monolithic, one-piece structure. Movable jaw 354 is coupled to fixed jaw 352 by use of jaw mover 356 and a fastener 360 for movement toward and away from fixed jaw 352 to clamp and unclamp bottom portion 338 between jaws 352, 354 in response to movement of jaw mover 356. Illustratively, jaw mover 356 includes a fastener 362 extending through jaws 352, 354 and a knob 364 coupled to fastener 362 to rotate fastener 362 to tighten and loosen clamp 348 in response rotation of knob 364 by person 34. The angle of inclination of support 324 and thus power unit 18 can be adjusted relative to screed bar 318 upon reduction of the clamping force on bottom portion 338 by clamps 348.

Each foot 350 is formed to include a slot 366 configured to receive a quick-release lever 368 of mount 342, as shown, for example, in FIG. 10. Lever 368 extends through slot 366 into a shoe 370 of mount 342 coupled to screed bar 318 by use of three fasteners 372 of mount 342 extending through screed bar 318 into a core 373 of mount 342 located in screed bar 318. One of fasteners 372 is horizontal and two of fasteners 372 are vertical. One of the two vertical fasteners 372 is positioned to one side of a reinforcement web 377 and the other (not shown) of the two vertical fasteners 372 is positioned to the opposite side of reinforcement web 377. Strut 344, feet 350, levers 368, shoes 370, fasteners 372, and core 373 cooperate to provide a base 367 of mount 342.

Screed bar 318 is coupled to mount 342 upon tightening of lever 368 against foot 350. Screed bar 318 can be readily uncoupled from mount 342 upon loosening of lever 368 relative to foot 360.

A lockable stand 374 is coupled to second side portion 336 by use of a pivot mount 365 for pivotable movement between a use position shown, for example, in FIG. 8 and a storage position shown, for example, in FIG. 9. A releasable stand lock 378 is coupled to pivot mount 365 to lock stand 374 in each of the use position and the storage position and to release stand 374 for pivotable movement between the use and storage positions.

First coupler 1116 includes first and second vibrator anchors 375, 376 for releasably anchoring vibrator 12 to screed 314, as shown, for example, in FIGS. 8-11. First vibrator anchor 375 is coupled to second side portion 336 and is adapted to couple to and uncouple from tube 36. Tube 36 thus acts as a mount portion. Second vibrator anchor 376 is adapted to couple to and uncouple from vibration head 20.

First vibrator 375 includes a support clamp 377 and a tube clamp 378, as shown, for example, in FIG. 11. Support clamp 377 is adapted to clamp and unclamp second side portion 336. Tube clamp 378 is adapted to clamp and unclamp tube 36.

Support clamp 377 includes a pair of jaws 379 and a jaw mover 380, as shown, for example, in FIG. 11. Jaws 379 receive second side portion 336 in an inclined channel 381 defined between jaws 379. Jaw mover 380 is coupled to both jaws 379 to move jaws 379 toward one another to tighten their grip on second side portion 336 and to move jaws 379 away from one another to loosen their grip on second side portion 336.

Tube clamp 378 includes a fixed jaw 382, a movable jaw 383, and a jaw mover 384, as shown, for example, in FIG. 11. Fixed jaw 382 is coupled to jaws 379 of support clamp 377. Movable jaw 383 overlies fixed jaw 382 and cooperates with fixed jaw 382 to define therebetween a channel 385 for receiving tube 36.

Jaw mover 384 includes a first fastener 386, a second fastener 387, and a knob 388. First fastener 386 extends through a slot 389 formed in movable jaw 383 into fixed jaw 382. Second fastener 387 extends into fixed jaw 382 through an open-ended slot 390 shown in FIG. 1*a* and formed in movable jaw 383. Knob 388 is coupled to second fastener 387 to rotate fastener 387 to cause movable jaw 383 to move toward fixed jaw 382 to clamp tube 36 therebetween and to cause movable jaw 383 to move away from fixed jaw 382 to unclamp tube 36.

When tube clamp 378 unclamps tube 36, movable jaw 383 can be rotated about an axis 391 defined by first fastener 386 to uncover tube 36 to allow removal of tube 36 from clamp 378. In so doing, second fastener 387 exits open-ended slot 390. To clamp tube 36, movable jaw 383 is rotated about axis 391 so that second fastener 387 is received in slot 390 and knob 388 is rotated to capture tube 36 between jaws 328, 383.

Second vibrator anchor 376 includes a head clamp 392, a platform 393, and a pair of fasteners 399, as shown, for example, in FIG. 12. Clamp 392 is coupled to platform 393 and is adapted to clamp and unclamp vibration head 20. Fasteners 399 extend through platform 393 into strut 344 to couple clamp 392 to frame 320.

Clamp 392 includes a pair of jaws 394 and a jaw mover 395 arranged to move jaws 394 toward one another to clamp vibration head 20 therebetween and to move jaws 394 away from one another to unclamp vibration head 20 to allow withdrawal of vibration head 20 from between jaws 394. Jaw mover 395 includes a pair of ears 396 coupled to jaws 394 and a threaded lever 397 that extends through apertures 398 formed in ears 396.

Figure 13:
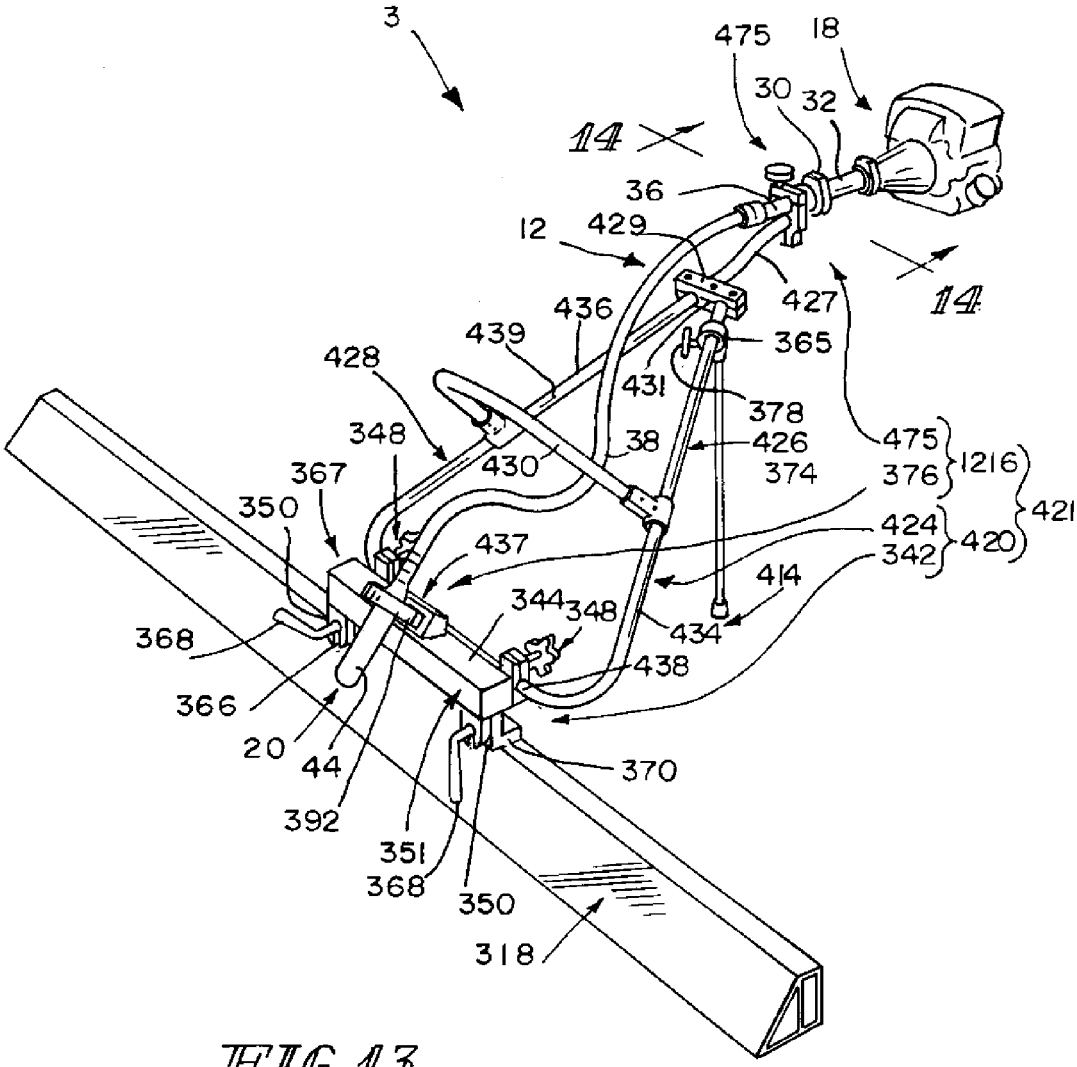
FIG. 13 is a perspective view showing use of a second coupler to couple the first vibrator to a second screed adapted to level concrete.

A second vibratory screed apparatus 3 includes first vibrator 12, a second screed 414 adapted to level concrete 24, and a second coupler 1216, as shown, for example, in FIG. 13. Second coupler 1216 is adapted to couple vibrator 12 to screed 414 to allow vibrator 12 to vibrate screed 414 during use of screed 414 to level concrete 24 and is adapted to uncouple vibrator 12 from screed 414 to allow use of vibrator 12 as a stand-alone device apart from screed 414 to vibrate concrete 24. Second coupler 1216 thus provides means for coupling vibrator 12 to screed 414 to allow vibrator 12 to vibrate screed 414 during use of screed 414 to finish concrete 24 and for uncoupling vibrator 12 from screed 414 to allow use of vibrator 12 as a stand-alone device apart from screed 414 to vibrate concrete 24.

Screed 414 includes screed bar 318 and a frame 420 to which screed bar 318 and second coupler 1216 are coupled. Coupler 1216 provides means for coupling power unit 18 and vibration head 20 to frame 420 to allow vibration head 20 to vibrate screed bar 318 in response to transmission of power from power unit 18 to vibration head 20 by use of drive shaft 40 extending through flexible hose 38. Frame 420 and second coupler 1216 thus provide an attachment device 421 coupling vibrator 12 to screed bar 318 to allow vibration head 20 to vibrate screed bar 318 in response to transmission of power from power unit 18 to vibration head 20 by use of drive shaft 40 extending through handle 32, inflexible tube 36, and flexible hose 38.

Frame 420 includes a support 424 and mount 342 to which screed bar 318 and support 424 are coupled. Support 424 and mount 342 cooperate to provide frame 420 with a generally triangular structure 426. Triangular structure 426 includes first and second side portions 434, 436 and a base portion 437. First and second side portions 434, 436 are provided by a main member 428 of support 424 and are coupled to one another by a clamp 429 of support to provide structure 426 with a vertex portion 431 opposite to base portion 437. Base portion 437 is provided by mount 342 and a bottom portion 438 of main member 428 which is coupled to clamps 348 of mount 342. A post 427 provided by main member 428 extends outwardly from vertex portion 431. First and second side portions 434, 436 and bottom portion 438 cooperate to provide main member 428 with a triangular portion 439 and post 427 extends outwardly from triangular portion 439. Lockable stand 374 is coupled to first side portion 436 by use of pivot mount 365 and lock 378 for pivotable movement between its use and storage positions.

A transverse member 430 of support 424 is coupled to first and second side portions 434, 436. Transverse member 430 may be used as a handle along with handle 32 of vibrator 12.

Second coupler 1216 includes first and second vibrator anchors 475, 376 for releasably anchoring vibrator 12 to screed 314, as shown, for example, in FIG. 13. First vibrator anchor 475 is coupled to post 427 and is adapted to couple to and uncouple from tube 36. Tube 36 thus acts as a mount portion. Second vibrator anchor 376 is adapted to couple to and uncouple from vibration head 20 as discussed above.

Figure 14:
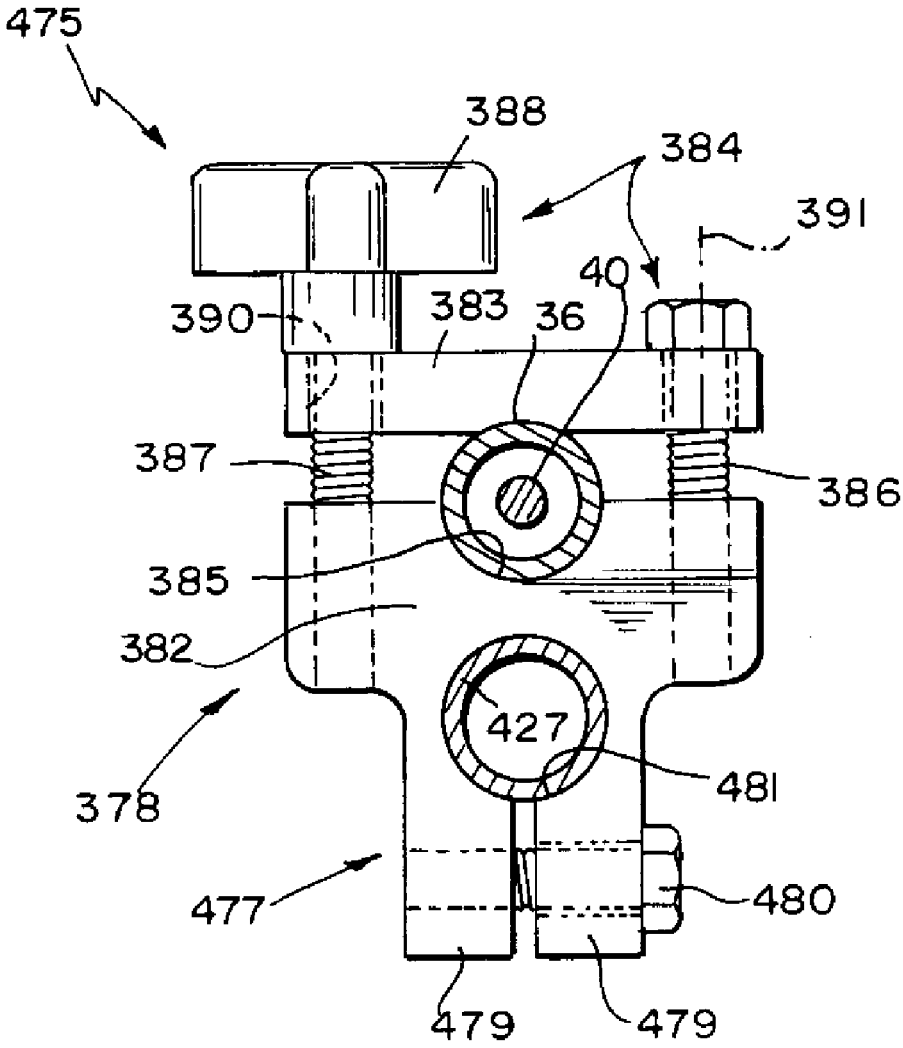
FIG. 14 is a sectional view taken along lines 14—14 of FIG. 13 showing a releasable upper tube clamp of the second coupler clamped to an tube of the first vibrator and a releasable lower frame clamp of the second coupler clamped to the frame of the second screed.

First vibrator anchor 475 includes a support clamp 477 and tube clamp 378, as shown, for example, in FIG. 14. Support clamp 477 is adapted to clamp and unclamp post 427. Tube clamp 378 is adapted to clamp and unclamp tube 36 as discussed above.

Support clamp 477 includes a pair of jaws 479 and a jaw mover 480. Jaws 479 receive post 427 in a non-inclined channel 481 defined between jaws 479. Jaw mover 480 is coupled to both jaws 479 to move jaws 479 toward one another to tighten their grip on post 427 and to move jaws 479 away from one another to loosen their grip on post 427.

Figure 15:
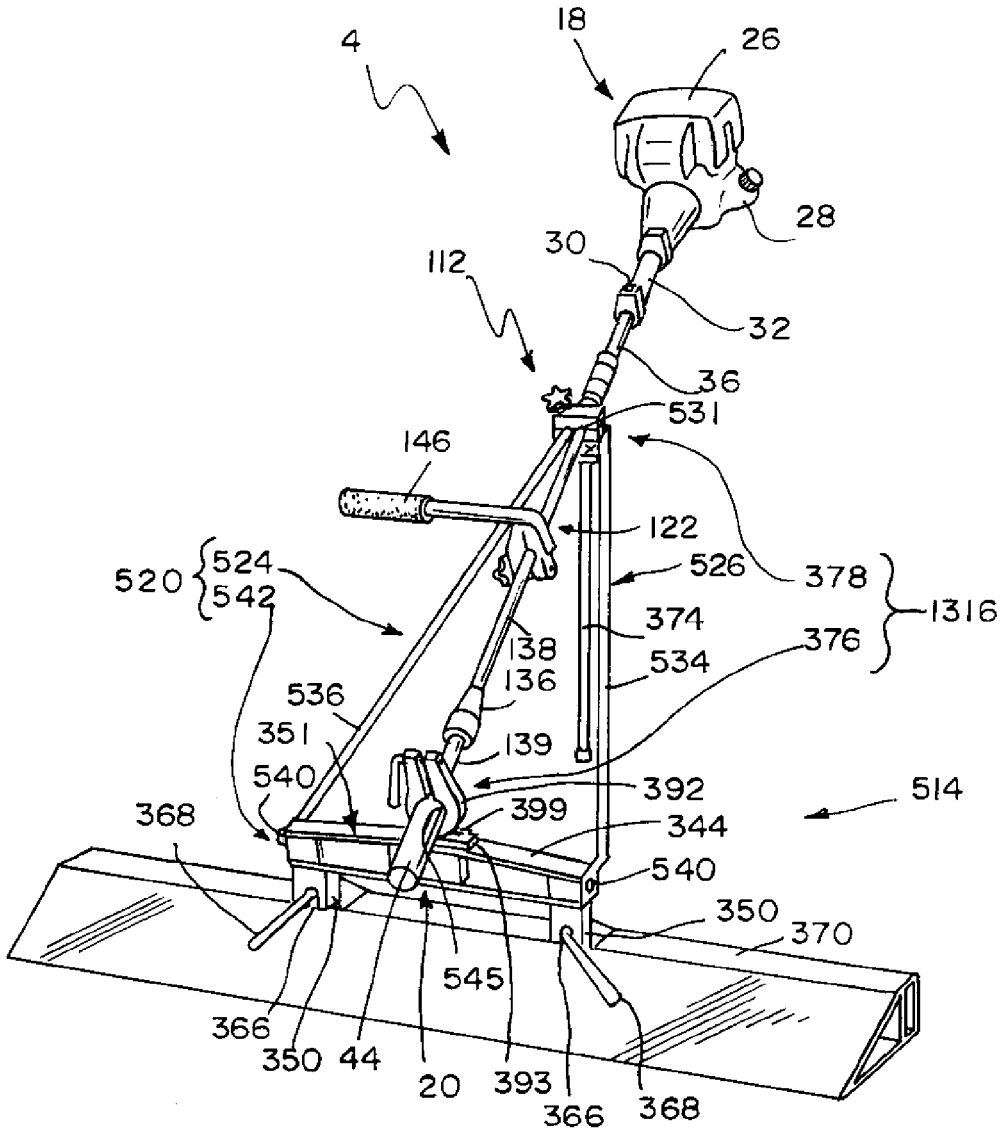
FIG. 15 is a perspective view showing use of a third coupler to couple the second vibrator to a third screed adapted to level concrete.

A third vibratory screed apparatus 4 includes second vibrator 112, a third screed 514 adapted to level concrete 24, and a third coupler 1316, as shown, for example, in FIG. 15. Third coupler 1316 is adapted to couple vibrator 112 to screed 514 to allow vibrator 112 to vibrate screed 514 during use of screed 514 to level concrete 24 and is adapted to uncouple vibrator 112 from screed 514 to allow use of vibrator 112 as a stand-alone device apart from screed 514 to vibrate concrete 24. Third coupler 1316 thus provides means for coupling vibrator 112 to screed 514 to allow vibrator 112 to vibrate screed 514 during use of screed 514 to finish concrete 24 and for uncoupling vibrator 112 from screed 514 to allow use of vibrator 112 as a stand-alone device apart from screed 514 to vibrate concrete 24.

Screed 514 includes screed bar 318 and a generally triangular frame 520 to which screed bar 318 and third coupler 1316 are coupled. Frame 520 includes a support 524 and a mount 542 to which screed bar 318 and support 524 are coupled. Mount 542 is similar to mount 342 except that it does not include clamps 348 since support 524 is coupled to strut 344.

Support 524 includes first and second side portions 534, 536 and a vertex portion 531. Each of first and second side portions 534, 536 is coupled at one end to strut 344 by a fastener 540 and at an opposite end to vertex portion 531 by a fastener 542. Vertex portion 531 connects side portions 534, 536 and is opposite to mount 542 which provides a base portion of the triangular shape of frame 520.

Figure 16:
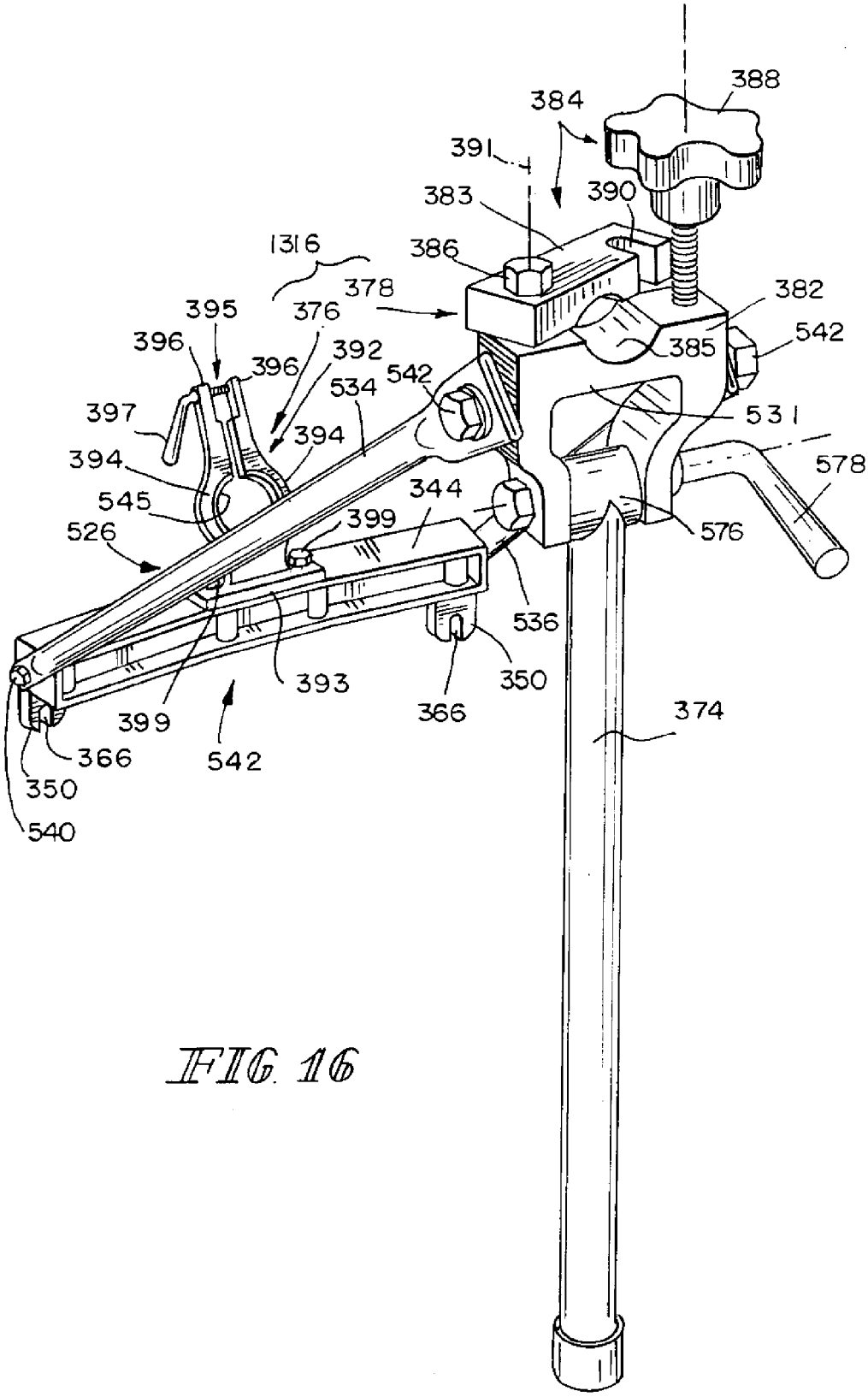
FIG. 16 is a perspective view showing an upper tube clamp and a lower head clamp of the third coupler coupled to a frame of the third screed.

Lockable stand 374 is coupled to vertex portion 531 by use of a pivot mount 576 for pivotable movement between a use position shown, for example, in FIGS. 15 and 16 and a storage position extending along vibrator 112. A releasable stand lock 578 is coupled to pivot mount 576 to lock stand 374 in each of the use position and the storage position and to release stand 374 for pivotable movement therebetween.

Third coupler 1316 includes releasable clamp 378 and second vibrator anchor 376 for releasably coupling vibrator 112 to screed 514, as shown, for example, in FIGS. 15 and 16. Fixed jaw 382 of clamp 378 is coupled to vertex portion 531 and cooperates with movable jaw 383 and jaw mover 384 to clamp and unclamp tube 138 of vibrator 112. Clamp 393 of mount 376 is adapted to clamp and unclamp vibration head 20. Illustratively, clamp 393 includes a pad 545 that is located between movable jaws 394 and cooperates with jaws 394 to clamp and unclamp vibration head 20. It is within the scope of this disclosure to omit pad 545 from clamp 393.

Figure 17:
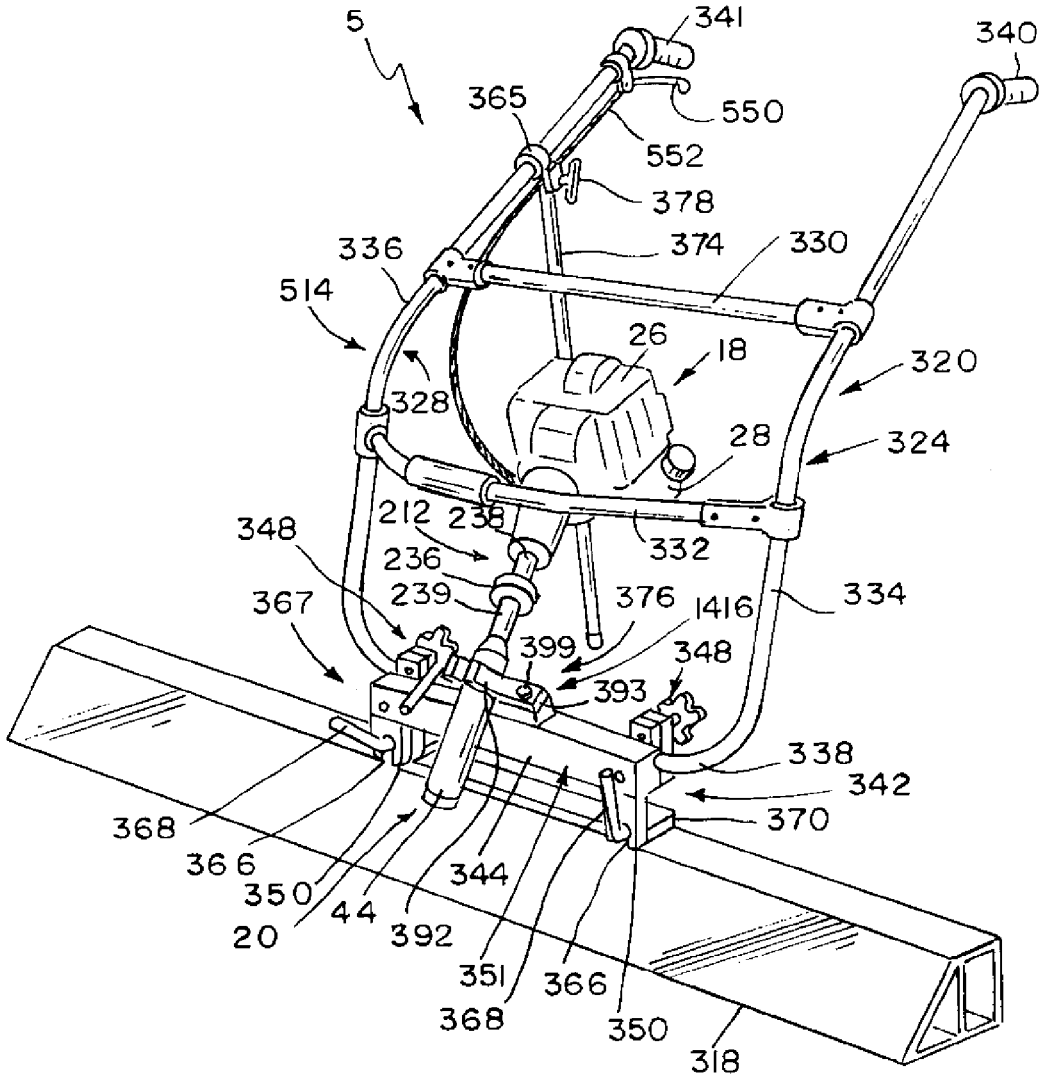
FIG. 17 is a perspective view showing use of a fourth coupler to couple the third vibrator to the first screed.
Figure 18:
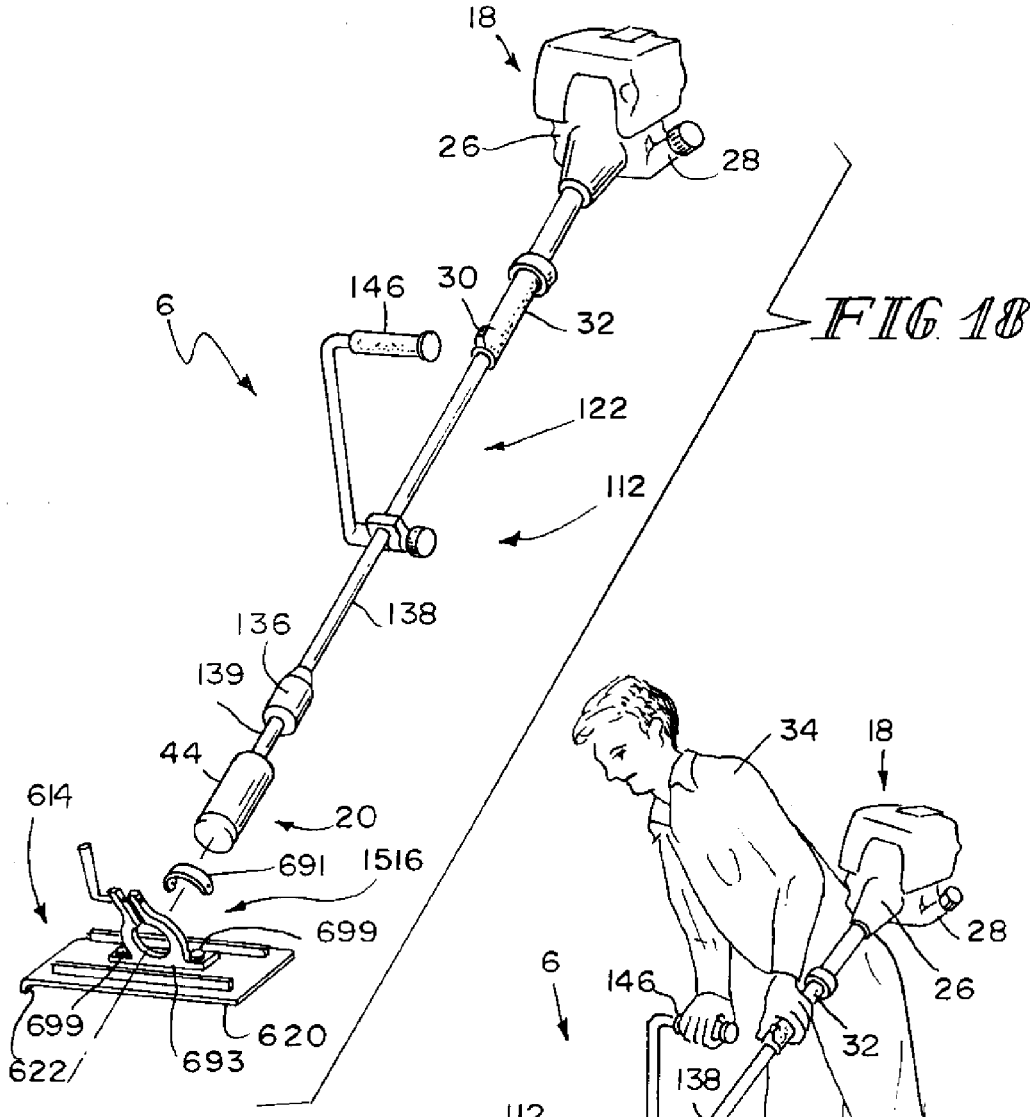
FIGS. 18 and 19 are perspective views showing use of a fifth coupler to couple the second vibrator to an edger adapted to form an edge in concrete.
Figure 19:
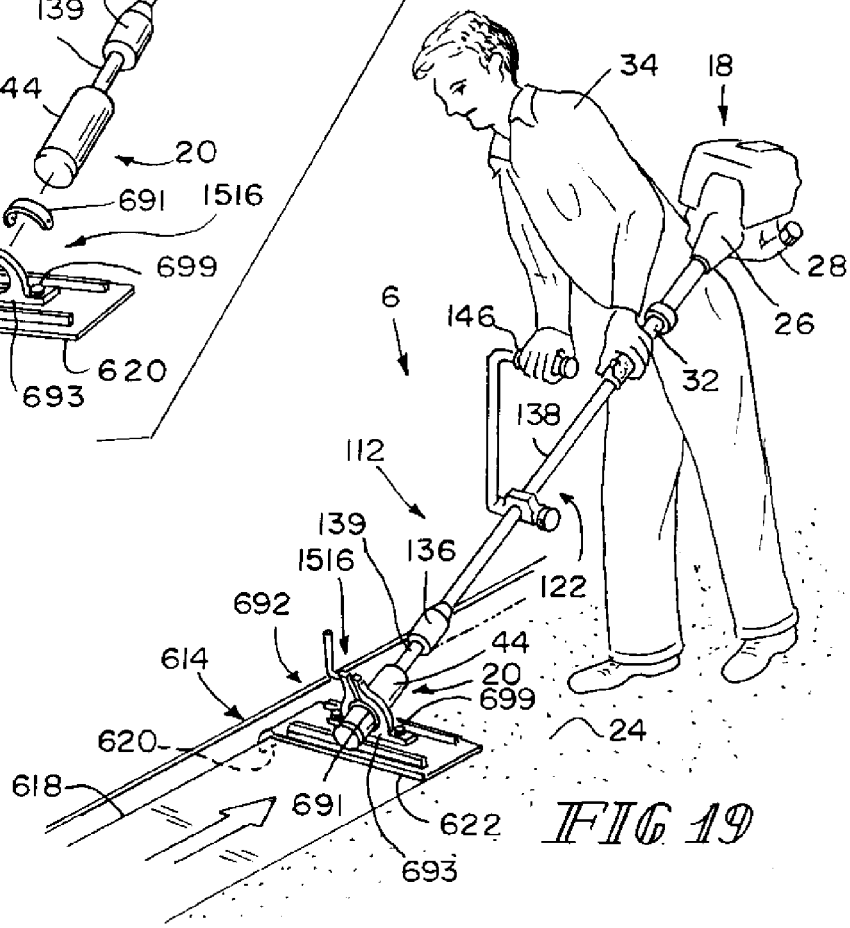
Figure 20:
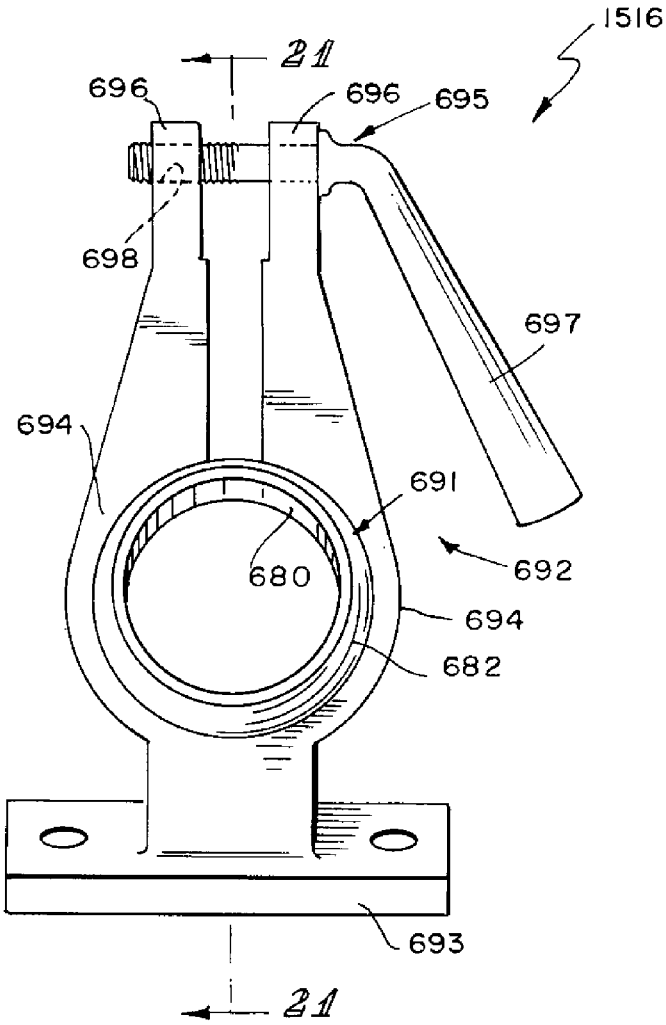
FIG. 20 is an elevation view of the fifth coupler which includes a ring mounted in a clamp.
Figure 21:
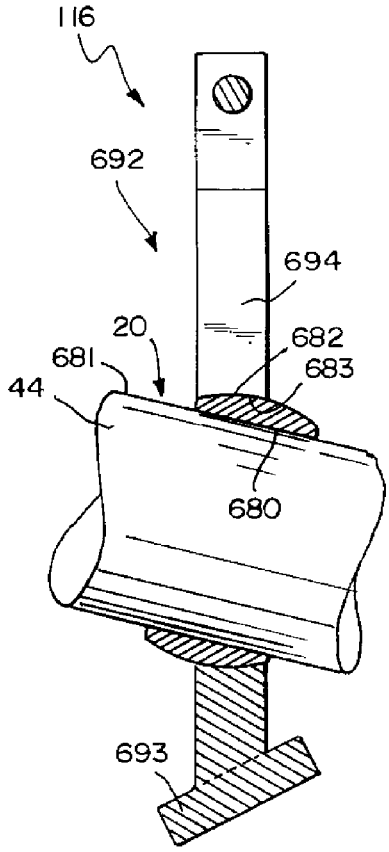
FIG. 21 is a sectional view taken along lines 21—21 of FIG. 20 showing a vibration head of the second vibrator extending through the ring.

A fourth vibratory screed apparatus 5 includes third vibrator 212, a first screed 314, and a fourth coupler 1416, as shown, for example, in FIG. 17. Fourth coupler 1416 is adapted to couple vibrator 212 to screed 314 to allow vibrator 212 to vibrate screed 314 during use of screed 314 to level concrete 24 and is adapted to uncouple vibrator 212 from screed 314 to allow use of vibrator 212 as a stand-alone device apart from screed 314 to vibrate concrete 24. Fourth coupler 1416 thus provides means for coupling vibrator 212 to screed 314 to allow vibrator 212 to vibrate screed 314 during use of screed 314 to finish concrete 24 and for uncoupling vibrator 212 from screed 314 to allow use of vibrator 212 as a stand-alone device apart from screed 314 to vibrate concrete 24.

Illustratively, fourth coupler 1416 is configured as second vibrator anchor 376. Clamp 393 of mount 376 is adapted to clamp vibration head 20 of vibrator 212 to couple vibrator 212 to screed 314 and is adapted to unclamp vibration head 20 to uncouple vibrator 212 from screed 314.

In apparatus 5, frame 320 of screed 314 is modified to include a second side handle 341 coupled to second side portion 336 and adapted to be gripped by person 34. An actuator 550 is arranged to act through a line 552 to control the speed of motor 26 in response to movement of actuator 550 by person 34.

A vibratory edger apparatus 6 includes second vibrator 112, an edger 614 adapted to form an edge 618 in concrete 24, and a fifth coupler 1516, as shown, for example, in FIG. 17. Fifth coupler 1516 is adapted to couple vibrator 112 to edger 614 to allow vibrator 112 to vibrate edger 614 during use of edger 614 to form edge 618 and is adapted to uncouple vibrator 112 from edger 614 to allow use of vibrator 112 as a stand-alone device apart from edger 614 to vibrate concrete 24. Fifth coupler 1516 thus provides means for coupling vibrator 112 to edger 614 to allow vibrator 112 to vibrate edger 614 during use of edger 614 to finish concrete 24 and for uncoupling vibrator 112 from edger 614 to allow use of vibrator 112 as a stand-alone device apart from edger 614 to vibrate concrete 24.

Edger 614 includes a plate 620 and a lip 622. Lip 622 depends from a side of plate 620 to form edge 618 in concrete 24.

Fifth coupler 1516 includes a clamp 692, a platform 693, a pair of fasteners 699, and a ring 691, as shown, for example, in FIGS. 18–21. Fasteners 694 couple platform 693 to plate 620. Clamp 692 is coupled to platform 693. Ring 691 is positioned within clamp 692 and adapted to receive vibration head 20 to allow adjustment of the orientation of vibrator 112 relative to edger 614 during use of apparatus 6.

During coupling of vibrator 112 to edger 614, ring 691 is coupled to vibration head 20. To do so, ring 691 is slid onto eccentric housing 44 so that an inner surface 680 of ring 691 mates with and surrounds an outer surface 681 of eccentric housing 44, as shown, for example, in FIG. 21. A jaw mover 695 of clamp 692 is operated to move jaws 694 of clamp 692 away from one another to receive ring 691 and vibration head 20 in clamp 692 between jaws 694. Jaw mover 695 is then operated to move jaws 694 toward one another to clamp ring 691 and thereby retain ring 691 and vibration head 20 in clamp 691.

Ring 691 and jaws 694 are configured to allow relative movement therebetween and thus allow adjustment of the orientation of vibrator 112 relative to edger 614. Ring 691 includes an outer convex surface 682 that is received by and arranged to move against an inner concave surface 683 formed in jaws 694 to allow adjustment of the orientation of vibrator 112 relative to edger 614.

To uncouple vibration 112 from edger 614, jaw mover 695 is operated to move jaws 694 away from one another to unclamp ring 691. Once unclamped, ring 691 and vibration head 20 is removed from clamp 692 and ring 691 is removed from eccentric housing 44.

Illustratively, jaw mover 695 includes a pair of ears 696 and a threaded lever 697. Ears 696 are coupled to jaws 694. Threaded lever 697 extends through apertures 698 formed in ears 696.

Figure 22:
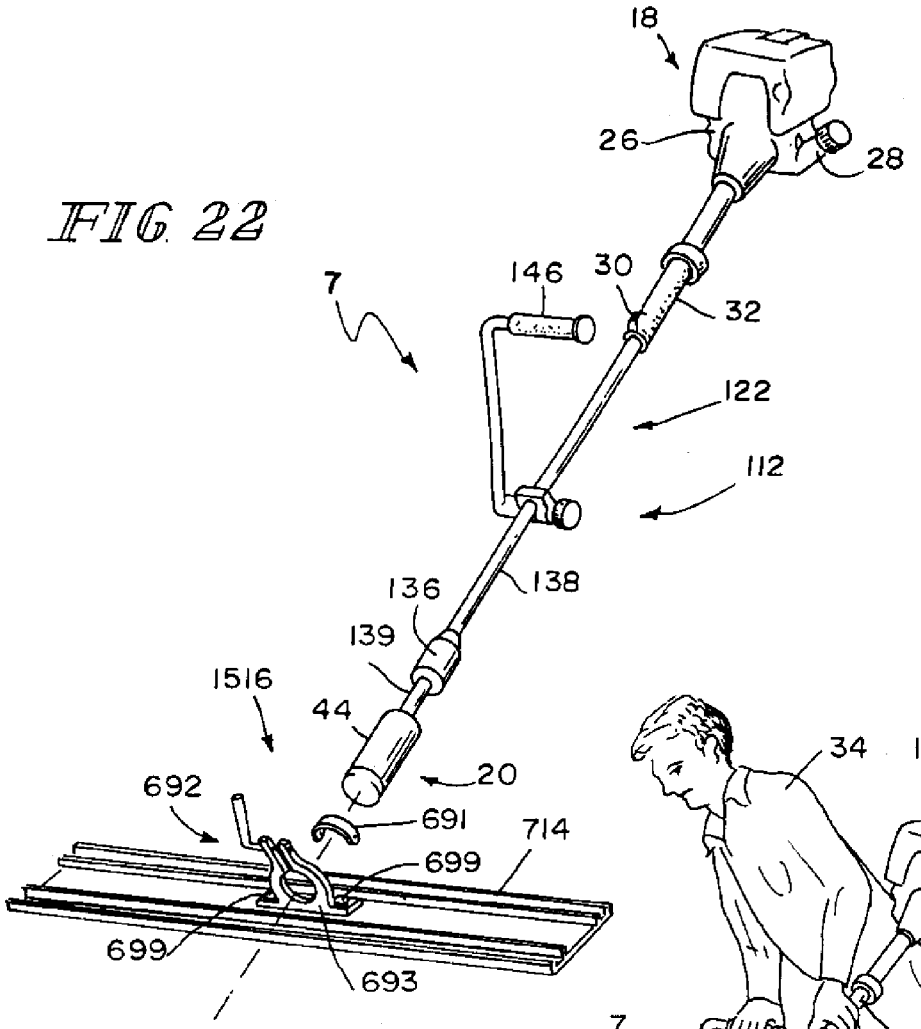
FIGS. 22 and 23 are perspective views showing use of the fifth coupler to couple the second vibrator to a float adapted to smooth a concrete surface.
Figure 23:
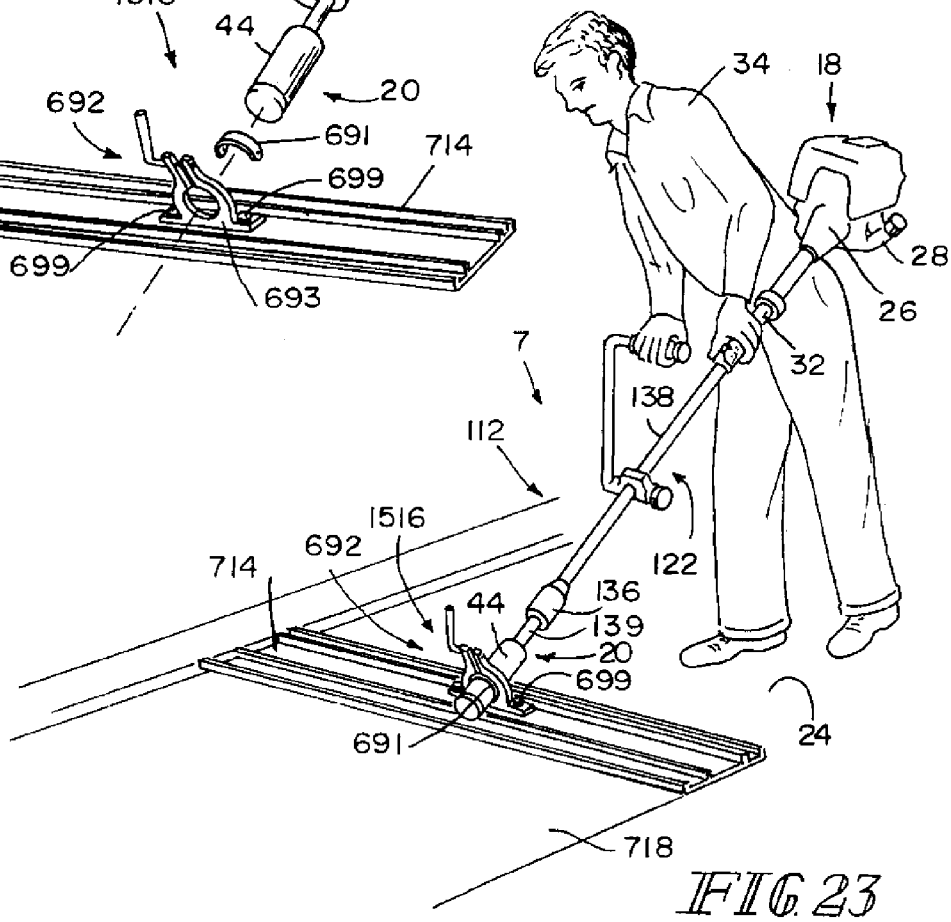

A vibratory float apparatus 7 includes second vibrator 112, a float 714 configured as a float plate adapted to smooth a surface 718 of concrete 24, and fifth coupler 1516, as shown, for example, in FIGS. 22 and 23. Fifth coupler 1516 is adapted to couple vibrator 112 to float 714 to allow vibrator 112 to vibrate float 714 during use of float 714 to smooth surface 718 and is adapted to uncouple vibrator 112 from float 714 to allow use of vibrator 112 as a stand-alone device apart from float 714 to vibrate concrete 24. Fifth coupler 1516 thus provides means for coupling vibrator 112 to float 714 to allow vibrator 112 to vibrate float 714 during use of float 714 to finish concrete 24 and for uncoupling vibrator 112 from float 714 to allow use of vibrator 112 as a stand-alone device apart from float 714 to vibrate concrete 24. Fifth coupler 1516 is adapted to allow adjustment of the orientation of vibrator 112 relative to float 714 during use of apparatus 7.

Figures 24, 25, 26:
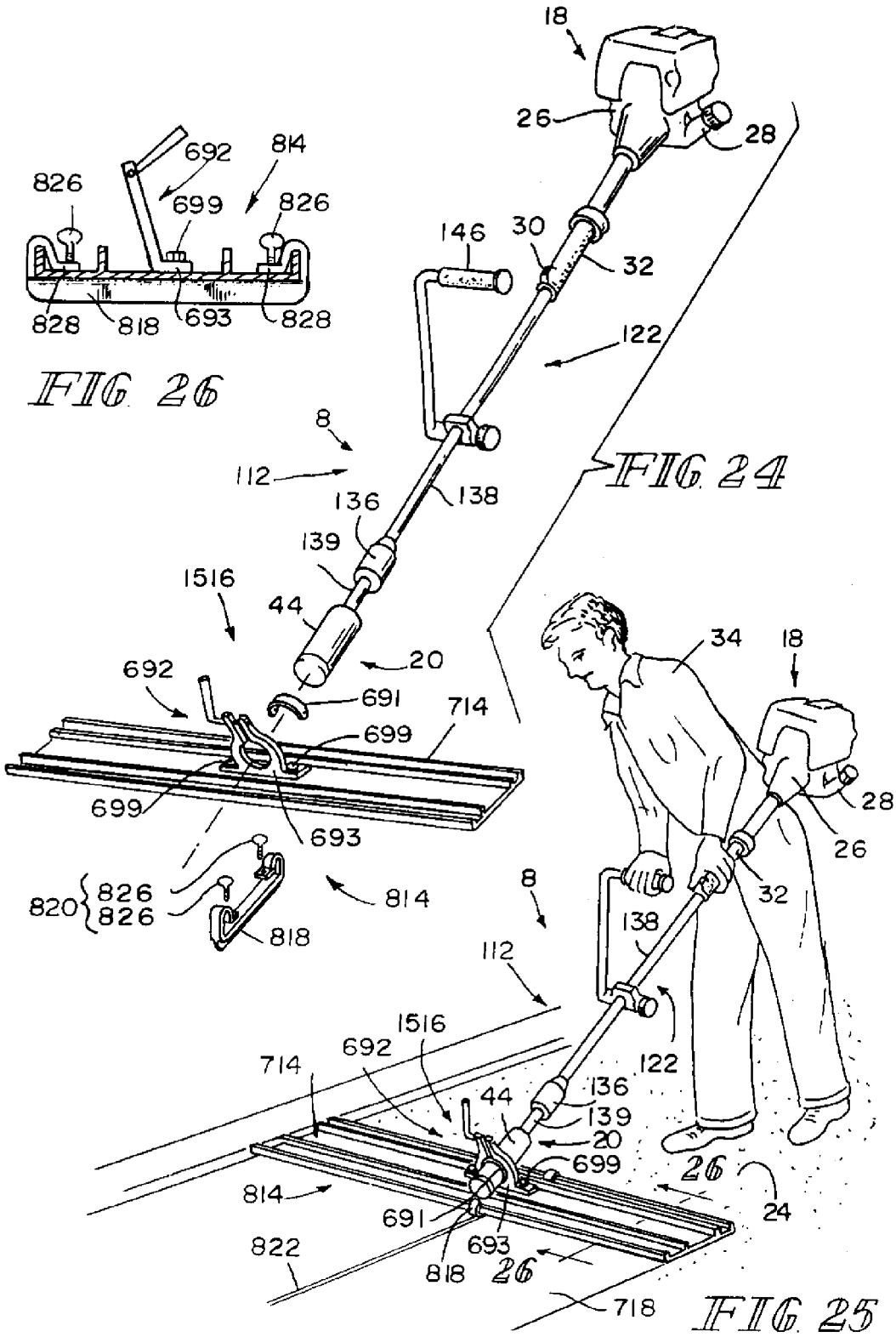
FIGS. 24 and 25 are perspective views showing use of the fifth coupler to couple the second vibrator to a groover adapted to form a groove in a surface of concrete.
FIG. 26 is a sectional view taken along lines 26—26 of FIG. 25.

A groover element 818 is coupled to float 714 by use of an element coupler 820 to convert vibratory float apparatus 7 into a vibratory groover apparatus 8, as shown, for example, in FIGS. 24–26. Together, groover element 818, element coupler 820, and float 714 cooperate to provide a groover 814 adapted to form a groove 822 in a surface 824 of concrete 24. Vibratory groover apparatus 8 thus includes second vibrator second vibrator 112, groover 814, and fifth coupler 1516.

Fifth coupler 1516 is adapted to couple vibrator 112 to groover 814 to allow vibrator 112 to vibrate groover 814 during use of groover 814 to form groove 822 in surface 824 and is adapted to uncouple vibrator 112 from groover 814 to allow use of vibrator 112 as a stand-alone device apart from groover 814 to vibrate concrete 24. Fifth coupler 1516 thus provides means for coupling vibrator 112 to groover 814 to allow vibrator 112 to vibrate groover 814 during use of groover 814 to finish concrete 24 and for uncoupling vibrator 112 from groover 814 to allow use of vibrator 112 as a stand-alone device apart from groover 814 to vibrate concrete 24. Fifth coupler 1516 is adapted to allow adjustment of the orientation of vibrator 112 relative to groover 814 during use of apparatus 8.

Element coupler 820 includes a pair of fasteners 826, as shown, for example, in FIG. 26. Fasteners 826 extend through flanges 828 of groover element 818 to engage float 714 to couple element 818 to float 714.

Figure 27:
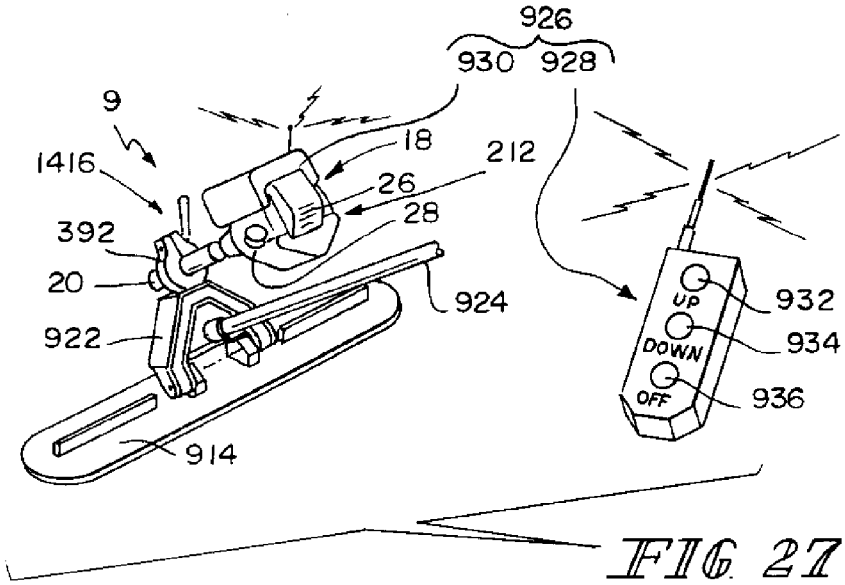
FIGS. 27 and 28 are perspective views showing use of the fourth coupler to couple the third vibrator to a float.
Figure 28:
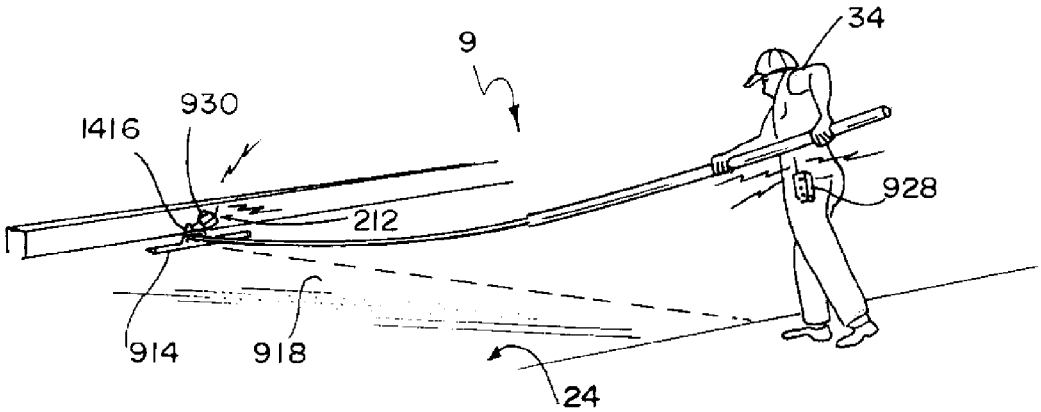

A vibratory float apparatus 9 includes third vibrator 212, a float 914 adapted to smooth a surface 918 of concrete 24, and a fourth coupler 1416, as shown, for example, in FIGS. 27 and 28. Fourth coupler 1416 is adapted to couple vibrator 212 to float 914 to allow vibrator 212 to vibrate float 914 during use of float 914 to smooth surface 918 and is adapted to uncouple vibrator 212 from float 914 to allow use of vibrator 212 as a stand-alone device apart from float 914 to vibrate concrete 24. Fourth coupler 1416 thus provides means for coupling vibrator 212 to float 914 to allow vibrator 212 to vibrate float 914 during use of float 914 to finish concrete 24 and for uncoupling vibrator 212 from float 914 to allow use of vibrator 212 as a stand-alone device apart from float 914 to vibrate concrete 24.

Float 914 includes a float plate 920, a mount 922, and a pole 924. Plate 920 is adapted to smooth surface 918. Mount 922 is coupled to plate 920. Pole 924 is coupled to mount 922 and adapted to be handled by person 34 to move float plate 920 along surface 918.

Fourth coupler 1416 is vibrator anchor 376. Mount 376 includes head clamp 392 adapted to clamp and unclamp vibration head 20 of vibrator 212. Clamp 392 is coupled to mount 922 by use of platform 393 underlying and coupled to clamp 392 and fasteners 399 coupled to platform 393 and mount 922.

Apparatus 9 includes a motor speed control device 926, as shown, for example, in FIGS. 27 and 28. Device 926 includes portable remote controller 928 and a driver 930. Remote controller 928 is configured to be carried by person 34 and to send signals wirelessly to driver 930 to cause driver 930 to adjust the speed of motor 26 and thereby adjust the amount of vibration imparted to plate 920.

Remote controller 928 includes an increase-speed control 932, a decrease-speed control 934, and a motor-off control 936, as shown, for example, in FIG. 27. Actuation of control 932 causes the speed of motor 26 to increase. Actuation of control 934 causes the speed of motor 26 to decrease. Actuation of control 936 causes motor 26 to turn off. Motor 26 is normally turned on by use of a control (not shown) on motor 26. It is within the scope of this disclosure for the remote controller 928 to include a control for turning motor 26 on.

Figure 29:
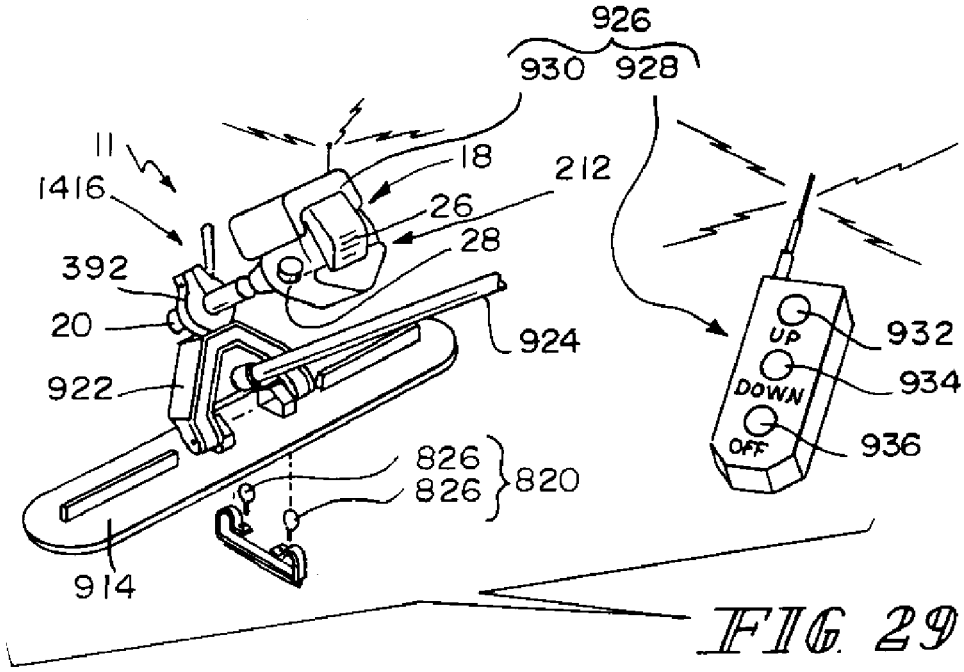
FIG. 29 is a perspective view showing use of the fourth coupler to couple the third vibrator to a groover.

Groover element 818 is coupled to float plate 920 by use of element coupler 820 to convert vibratory float apparatus 9 into a vibratory groover apparatus 11, as shown, for example, in FIG. 29. Together, groover element 818, element coupler 820, and float 914 cooperate to provide a groover 1014 adapted to form a groove in a surface of concrete 24. Vibratory groover apparatus 11 thus includes second vibrator second vibrator 112, groover 1014, and fourth coupler 1416.

Fourth coupler 1416 is adapted to couple vibrator 212 to groover 1014 to allow vibrator 212 to vibrate groover 1014 during use of groover 1014 to form a groove in a the concrete surface and is adapted to uncouple vibrator 212 from groover 1014 to allow use of vibrator 212 as a stand-alone device apart from groover 1014 to vibrate concrete 24. Fourth coupler 1416 thus provides means for coupling vibrator 212 to groover 1014 to allow vibrator 212 to vibrate groover 1014 during use of groover 1014 to finish concrete 24 and for uncoupling vibrator 212 from groover 1014 to allow use of vibrator 212 as a stand-alone device apart from groover 1014 to vibrate concrete 24.

A concrete-finishing kit thus includes components capable of being assembled and disassembled in the field. The kit comprises a concrete vibrator, a concrete-finishing tool, and a coupler. The coupler is adapted to couple the vibrator to the tool to allow the vibrator to vibrate the tool during use of the tool to finish concrete and adapted to uncouple the vibrator from the tool to allow use of the vibrator as a stand-alone device apart from the tool to vibrate concrete. The concrete-finishing tool may be configured, for example, as any one of a screed, an edger, a float, and a groover. It is to be understood that the tool may be other concrete-finishing tools.

The invention claimed is:

1. A vibratory screed apparatus comprising a frame, screed bar coupled to the frame, a flexible-hose vibrator including a power unit, a vibration head, a flexible hose extending between the power unit and the vibration head, and a flexible drive shaft extending from the power unit through the flexible hose to the vibration bead, the flexible drive shaft being coupled for rotation with respect to the flexible hose, and means for coupling the power unit and the vibration head to the frame to allow the vibration head to vibrate the screed bar in response to transmission of power from the power unit to the vibration head by use of the flexible drive shaft extending through the flexible hose.

2. The vibratory screed apparatus of claim 1, wherein the flexible-hose vibrator further includes an inflexible tube through which the drive shaft extends, the vibration head includes an eccentric housing and an eccentric mounted for rotation in the eccentric housing and coupled to the drive shaft, and the coupling means includes a first clamp coupled to the frame and clamped to the eccentric housing and a second clamp coupled to the frame and clamped to the inflexible tube.

3. The vibratory screed apparatus of claim 1, wherein the flexible-hose vibrator includes an inflexible tube through which the drive shaft extends and the coupling means includes an anchor coupled to the frame and the inflexible tube.

4. The vibratory screed apparatus of claim 3, wherein the anchor includes a clamp clamping the inflexible tube for release therefrom.

5. The vibratory screed apparatus of claim 3, wherein the power unit includes a motor and the inflexible tube is positioned between the motor and the flexible hose.

6. The vibratory screed apparatus of claim 1, wherein the frame includes a mount and a support, the mount is coupled to the screed bar, the support includes a first side portion, a second side portion, and a bottom portion coupled to the mount and connecting the first side portion and the second side portion, and the coupling means includes an anchor coupled to the first side portion and anchoring the power unit to one of the first and second side portions.

7. The vibratory screed apparatus of claim 6, wherein the first side portion includes a first side handle adapted to be gripped by a person, the flexible-hose vibrator includes a motor, an inflexible tube that is coupled to the flexible hose and through which the drive shaft extends, and a second side handle that is adapted to be gripped by the person and is coupled to the inflexible tube and the motor, and the anchor includes a clamp coupled to the second side portion and the inflexible tube.

8. The vibratory screed apparatus of claim 1, wherein the coupling means includes a first clamp and a second clamp, the frame includes a generally triangular structure and a post, the generally triangular structure includes a base portion and a vertex portion opposite to the base pardon, the screed bar and the first clamp are coupled to the base portion, the post extends outwardly from the vertex portion, the flexible-hose vibrator includes an inflexible tube coupled to the flexible hose and a handle that is adapted to be gripped by a person and that extends between the inflexible tube and a motor included in the power unit, the first clamp is coupled to the vibration head, and the second clamp is coupled to the post and clamps the inflexible tube for release therefrom.

9. A vibratory screed apparatus comprising a flexible-hose vibrator including a flexible hose and a drive shaft extending through and rotatable with respect to the flexible hose, a screed bar, and an attachment device coupling the flexible-hose vibrator to the screed bar.

10. The vibratory screed apparatus of claim 9, wherein the flexible-hose vibrator includes an inflexible tube through which the drive shaft extends, and the attachment device is coupled to the inflexible tube.

11. The vibratory screed apparatus of claim 10, wherein the power unit includes a motor arranged to rotate the drive shaft, the flexible-hose vibrator includes a handle extending between the motor and the inflexible tube, the inflexible tube extends between the handle and the flexible hose, and the drive shaft extends through the inflexible tube.

12. The vibratory screed apparatus of claim 10, wherein the attachment device includes a frame and a clamp including a lower jaw coupled to the frame, an upper jaw cooperating with the lower jaw to receive the inflexible tube therebetween, and a jaw mover arranged to move the upper jaw toward and away from the lower jaw to clamp and unclamp the inflexible tube.

13. The vibratory screed apparatus of claim 12, wherein the jaw mover includes a rotatable knob adapted to be rotated by hand to cause the upper and lower jaws to clamp and unclamp the inflexible tube.

14. The vibratory screed apparatus of claim 9, wherein the power unit includes a motor, the flexible-hose vibrator includes a mount portion positioned between the motor and the flexible hose, and the attachment device includes a clamp clamping the mount portion.

15. The vibratory screed apparatus of claim 9, wherein the attachment device includes a base coupled to the screed bar, a support coupled to the power unit, and a releasable clamp coupled to the base and clamping the support for release of the support to allow movement of the support relative to the base to adjust the position of the power unit relative to the screed bar.

16. The vibratory screed apparatus of claim 9, wherein the attachment device includes a yoke coupled to the screed bar, releasable first, second, and third clamps, and a U-shaped member, the first and second clamps are coupled to the yoke, the first clamp clamps the vibration head, the U-shaped member includes a first side portion, a second side portion, and a bottom portion clamped by the second clamp, the first side portion includes a first side handle adapted to be gripped by a person, the third clamp is coupled to the second side portion and clamps an inflexible tube that is included in the flexible-hose vibrator and through which the drive shaft extends, and the flexible-hose vibrator includes a second side handle that is adapted to be gripped by the person and is positioned between the inflexible tube and a motor included in the power unit.

17. The vibratory screed apparatus of claim 9, wherein the attachment device includes a yoke coupled to the screed bar, releasable first, second, and third clamps, and a support member, the first and second clamps are coupled to the yoke, the first clamp clamps the vibration head, the support member includes a triangular portion coupled to the second clamp and a post extending from the triangular portion, the third clamp is coupled to the post and clamps an inflexible tube that is included in the flexible-hose vibrator and through which the drive shaft extends, and the flexible-hose vibrator includes a handle that is adapted to be gripped by a person and is positioned between the inflexible tube and a motor included in the power unit.

18. A concrete-finishing kit including components capable of being assembled and disassembled in the field, the concrete-finishing kit comprising a flexible-hose vibrator including a flexible hose and a drive shaft extending through and rotatable with respect to the flexible hose, a screed, and a coupler adapted to couple the flexible-hose vibrator to the screed to allow the flexible-hose vibrator to vibrate the screed during use of the tool to screed concrete and adapted to uncouple the flexible-hose vibrator from the screed to allow use of the flexible-hose vibrator as a stand-alone device apart from the screed to vibrate concrete.

19. The concrete-finishing kit of claim 18, wherein the flexible-hose vibrator includes an inflexible tube through the drive shaft extends and the coupler includes a clamp adapted to clamp and unclamp the inflexible tube.

20. The concrete-finishing kit of claim 18, wherein the flexible-hose vibrator includes a power unit, a handle, an inflexible tube, and a vibration head including an eccentric housing and an eccentric positioned for rotation in the eccentric housing, the handle is positioned between the power unit and the inflexible tube, the inflexible tube is positioned between the handle and the flexible hose, and the flexible hose is positioned between the inflexible tube and the eccentric housing, and the drive shaft extends from the power unit through the handle, the inflexible tube, and the flexible hose to the eccentric, and the coupler includes a first clamp adapted to clamp and unclamp the eccentric housing and a second clamp adapted to clamp and unclamp the inflexible tube.

* * * * *